US007762008B1

(12) United States Patent
Clark et al.

(10) Patent No.: US 7,762,008 B1
(45) Date of Patent: Jul. 27, 2010

(54) EXTREME SERVICE FOOTWEAR

(75) Inventors: Douglas E. Clark, Durham, NH (US); David E. Miller, Dayton, ME (US); Peter Dillon, Topsfield, MA (US)

(73) Assignee: The Timberland Company, Stratham, NH (US)

( * ) Notice: Subject to any disclaimer, the term of this patent is extended or adjusted under 35 U.S.C. 154(b) by 958 days.

(21) Appl. No.: 11/516,859

(22) Filed: Sep. 7, 2006

Related U.S. Application Data

(60) Provisional application No. 60/714,619, filed on Sep. 7, 2005.

(51) Int. Cl.
*A43B 7/06* (2006.01)

(52) U.S. Cl. ..... 36/3 B; 36/44

(58) Field of Classification Search ..... 36/43, 36/44, 3 R, 3 B, 97
See application file for complete search history.

(56) References Cited

U.S. PATENT DOCUMENTS

| | | | | |
|---|---|---|---|---|
| 760,401 | A * | 5/1904 | Sandmeyer | 36/3 R |
| 981,154 | A | 1/1911 | Austin | |
| 1,061,353 | A | 5/1913 | Everston | |
| 1,075,806 | A | 10/1913 | Austin | |
| 1,079,535 | A | 11/1913 | Austin | |
| 1,115,038 | A | 10/1914 | Tweedie | |
| 1,191,122 | A | 7/1916 | Brown | |
| 1,289,711 | A | 12/1918 | Sweasy et al. | |
| 1,401,981 | A | 1/1922 | Hill | |
| 1,408,267 | A | 2/1922 | Caterini | |
| 1,477,825 | A | 12/1923 | Heitler | |
| 1,523,956 | A | 1/1925 | Grosjean | |
| 1,524,997 | A | 2/1925 | Potter | |
| 1,546,245 | A | 7/1925 | Luck | |
| 1,733,678 | A | 10/1929 | Torchia | |
| 1,739,538 | A | 12/1929 | Block | |
| 1,853,998 | A | 4/1932 | Sadler | |
| 1,872,604 | A | 8/1932 | Pierce | |

(Continued)

FOREIGN PATENT DOCUMENTS

| | | |
|---|---|---|
| DE | 3106729 | 9/1982 |

(Continued)

OTHER PUBLICATIONS

"PBI TurtleSkin," Warwick Mills, 2 pgs. © 2006.

*Primary Examiner*—Marie Patterson
(74) *Attorney, Agent, or Firm*—Lerner, David, Littenberg, Krumholz & Mentlik, LLP

(57) ABSTRACT

The present invention provides articles of footwear adapted for use in extreme and hazardous environments by members of the military, law enforcement personnel and others who require durable and functional footwear. The footwear include protective coverings that may be proof, puncture proof, fire retardant or water repelling. Drainage holes can be positioned in the toe region and along the outsole to enable a wearer to quickly drain water from the article of footwear. Single use or replaceable drainage plugs may cover the holes to prevent entry of water into the boot or other article of footwear. Removable and/or replaceable footbeds may be employed, and such footbeds may provide adjustable sizing of the article of footwear using interchangeable cartridges. A support saddle may be employed with the footbed to enhance foot support under heavy loads. These and other features herein are suited for use in a wide variety of footwear.

19 Claims, 29 Drawing Sheets

U.S. PATENT DOCUMENTS

| | | | | | |
|---|---|---|---|---|---|
| 1,890,433 | A | * | 12/1932 | Cohen | 36/3 A |
| 1,895,327 | A | | 1/1933 | Horning | |
| 1,907,997 | A | | 5/1933 | Nickerson | |
| 1,964,806 | A | | 7/1934 | Barnett | |
| 1,986,124 | A | | 1/1935 | Smith | |
| 1,999,507 | A | | 4/1935 | Lyss | |
| 2,035,561 | A | | 3/1936 | McCullough | |
| 2,053,910 | A | | 9/1936 | Kingsbury | |
| 2,090,065 | A | | 8/1937 | Parker | |
| 2,127,255 | A | | 8/1938 | Flint | |
| 2,194,637 | A | | 3/1940 | Burger | |
| 2,212,414 | A | | 8/1940 | Burger | |
| 2,220,439 | A | | 11/1940 | Block | |
| 2,260,270 | A | | 10/1941 | Boos | |
| 2,312,370 | A | | 3/1943 | Soule | |
| 2,482,333 | A | | 9/1949 | Everston | |
| 2,581,524 | A | | 1/1952 | Ford | |
| 2,605,559 | A | | 8/1952 | Vail | |
| 2,835,908 | A | | 5/1958 | Mott | |
| 3,091,042 | A | | 5/1963 | Gilkerson | |
| 3,124,887 | A | | 3/1964 | Vassar | |
| 3,442,031 | A | | 5/1969 | Antell | |
| 4,100,685 | A | * | 7/1978 | Dassler | 36/3 B |
| 4,231,169 | A | | 11/1980 | Toyama et al. | |
| 4,481,726 | A | | 11/1984 | Phillips | |
| 4,523,395 | A | | 6/1985 | Borsoi et al. | |
| 4,557,060 | A | | 12/1985 | Kawashima et al. | |
| 4,608,988 | A | | 9/1986 | Dananberg | |
| 4,624,061 | A | | 11/1986 | Wezel et al. | |
| 4,674,206 | A | | 6/1987 | Lyden | |
| 4,739,765 | A | | 4/1988 | Sydor et al. | |
| 4,765,070 | A | | 8/1988 | Chemello et al. | |
| 4,783,910 | A | | 11/1988 | Boys, II et al. | |
| 4,791,736 | A | | 12/1988 | Phillips | |
| 4,794,707 | A | | 1/1989 | Franklin et al. | |
| 4,858,341 | A | | 8/1989 | Rosen | |
| 4,864,740 | A | | 9/1989 | Oakley | |
| 4,897,938 | A | | 2/1990 | Otsuka et al. | |
| 4,910,887 | A | * | 3/1990 | Turner et al. | 36/114 |
| 4,918,838 | A | | 4/1990 | Chang et al. | |
| 4,924,605 | A | | 5/1990 | Spademan | |
| 4,924,606 | A | | 5/1990 | Montgomery et al. | |
| 4,939,851 | A | * | 7/1990 | Miller | 36/3 B |
| 4,967,492 | A | | 11/1990 | Rosen | |
| RE33,648 | E | | 7/1991 | Brown | |
| 5,060,402 | A | | 10/1991 | Rosen | |
| 5,123,181 | A | | 6/1992 | Rosen | |
| 5,138,774 | A | | 8/1992 | Sarkozi | |
| 5,146,698 | A | * | 9/1992 | Tilles et al. | 36/44 |
| 5,163,237 | A | | 11/1992 | Rosen | |
| 5,179,791 | A | | 1/1993 | Lain | |
| 5,187,883 | A | | 2/1993 | Penney | |
| 5,212,878 | A | | 5/1993 | Burke et al. | |
| 5,226,247 | A | | 7/1993 | Ambrose | |
| 5,241,762 | A | | 9/1993 | Rosen | |
| 5,255,451 | A | | 10/1993 | Tong et al. | |
| 5,325,614 | A | | 7/1994 | Rosen | |
| 5,345,701 | A | | 9/1994 | Smith | |
| 5,367,791 | A | | 11/1994 | Gross et al. | |
| 5,404,658 | A | | 4/1995 | Rosen | |
| 5,438,768 | A | | 8/1995 | Bauerfeind et al. | |
| 5,497,566 | A | | 3/1996 | Kousaka et al. | |
| 5,528,842 | A | | 6/1996 | Ricci et al. | |
| 5,533,280 | A | | 7/1996 | Halliday | |
| 5,572,805 | A | | 11/1996 | Giese et al. | |
| 5,647,147 | A | | 7/1997 | Coomer | |
| 5,655,315 | A | | 8/1997 | Mershon | |
| 5,659,980 | A | | 8/1997 | Lin | |
| 5,724,753 | A | | 3/1998 | Throneburg et al. | |
| 5,727,335 | A | | 3/1998 | Kousaka et al. | |
| 5,732,481 | A | | 3/1998 | Farhad | |
| 5,733,647 | A | | 3/1998 | Moore, III et al. | |
| 5,768,803 | A | | 6/1998 | Levy | |
| 5,799,414 | A | | 9/1998 | Kellerman | |
| 5,813,145 | A | | 9/1998 | Prober et al. | |
| 5,813,146 | A | | 9/1998 | Gutkowski et al. | |
| 5,853,863 | A | | 12/1998 | Kim | |
| 5,855,079 | A | | 1/1999 | Herbert et al. | |
| 5,881,478 | A | | 3/1999 | McMahon et al. | |
| 5,892,171 | A | | 4/1999 | Ide et al. | |
| 5,926,977 | A | | 7/1999 | Sanders | |
| 5,958,546 | A | | 9/1999 | Mardix et al. | |
| 5,983,524 | A | * | 11/1999 | Polegato | 36/3 R |
| 6,000,147 | A | | 12/1999 | Kellerman | |
| 6,023,857 | A | | 2/2000 | Vizy et al. | |
| 6,092,310 | A | | 7/2000 | Schoesler et al. | |
| 6,092,311 | A | | 7/2000 | MacNamara | |
| 6,092,314 | A | | 7/2000 | Rothbart | |
| 6,101,743 | A | | 8/2000 | Brown | |
| 6,125,557 | A | | 10/2000 | Brown | |
| 6,138,382 | A | | 10/2000 | Schoesler et al. | |
| 6,159,590 | A | | 12/2000 | Kim | |
| 6,170,176 | B1 | | 1/2001 | Clough | |
| 6,178,663 | B1 | | 1/2001 | Schoesler et al. | |
| 6,205,683 | B1 | | 3/2001 | Clark et al. | |
| 6,205,685 | B1 | | 3/2001 | Kellerman | |
| 6,259,555 | B1 | | 7/2001 | Meli et al. | |
| 6,269,555 | B1 | | 8/2001 | Brown | |
| 6,349,487 | B1 | | 2/2002 | Hice | |
| 6,374,515 | B1 | | 4/2002 | Davis | |
| 6,408,543 | B1 | | 6/2002 | Erickson et al. | |
| 6,442,874 | B1 | | 9/2002 | Long | |
| 6,453,578 | B1 | | 9/2002 | Yung et al. | |
| 6,470,599 | B1 | | 10/2002 | Chu | |
| 6,474,003 | B2 | | 11/2002 | Erickson et al. | |
| 6,481,120 | B1 | | 11/2002 | Xia et al. | |
| 6,513,265 | B2 | | 2/2003 | Hanks | |
| 6,536,137 | B1 | | 3/2003 | Celia | |
| 6,584,476 | B1 | | 6/2003 | Chatterjee et al. | |
| 6,584,707 | B1 | | 7/2003 | Racine et al. | |
| 6,601,320 | B1 | | 8/2003 | Brown | |
| 6,601,321 | B1 | | 8/2003 | Kendall | |
| 6,606,804 | B2 | | 8/2003 | Kaneko et al. | |
| 6,609,314 | B1 | | 8/2003 | Dubner | |
| 6,625,906 | B2 | | 9/2003 | Mayer et al. | |
| 6,681,500 | B2 | | 1/2004 | Moretti | |
| 6,701,638 | B1 | | 3/2004 | Polato et al. | |
| 6,708,427 | B2 | | 3/2004 | Sussmann et al. | |
| 6,718,658 | B2 | | 4/2004 | Karasawa | |
| 6,720,277 | B1 | | 4/2004 | Howland | |
| 6,732,457 | B2 | | 5/2004 | Gardiner et al. | |
| 6,748,676 | B1 | | 6/2004 | Chenevert et al. | |
| 6,792,699 | B2 | | 9/2004 | Long et al. | |
| 6,802,138 | B2 | | 10/2004 | McManus et al. | |
| 6,848,200 | B1 | | 2/2005 | Westin | |
| 6,871,421 | B2 | | 3/2005 | Potter et al. | |
| 6,874,251 | B2 | | 4/2005 | Moretti | |
| 6,920,707 | B1 | * | 7/2005 | Greene et al. | 36/97 |
| 6,948,260 | B2 | * | 9/2005 | Lin et al. | 36/3 B |
| 6,976,319 | B2 | * | 12/2005 | Pfander | 36/3 R |
| 7,210,250 | B2 | | 5/2007 | Gallegos | |
| 7,461,470 | B2 | * | 12/2008 | Dardinski et al. | 36/100 |
| 2002/0014042 | A1 | | 2/2002 | Price | |
| 2002/0017035 | A1 | | 2/2002 | Treptow et al. | |
| 2002/0020078 | A1 | | 2/2002 | Bressoux et al. | |
| 2002/0020081 | A1 | | 2/2002 | Brooks | |
| 2002/0189135 | A1 | | 12/2002 | Hanks | |
| 2003/0005599 | A1 | | 1/2003 | Panaccione | |
| 2003/0061733 | A1 | * | 4/2003 | Karsten | 36/43 |
| 2003/0097770 | A1 | | 5/2003 | Karasawa | |
| 2003/0200675 | A1 | | 10/2003 | Gross | |
| 2003/0200676 | A1 | | 10/2003 | Gross | |
| 2003/0226288 | A1 | | 12/2003 | Brown | |
| 2004/0049950 | A1 | | 3/2004 | Van Horne | |

| | | | | |
|---|---|---|---|---|
| 2004/0049951 | A1 | 3/2004 | Chen | |
| 2004/0064974 | A1 | 4/2004 | Schuster | |
| 2004/0068893 | A1 | 4/2004 | Kendall | |
| 2004/0103561 | A1 | 6/2004 | Campbell et al. | |
| 2004/0111923 | A1 | 6/2004 | Brooks | |
| 2004/0118017 | A1 | 6/2004 | Dalton et al. | |
| 2004/0128861 | A1 | 7/2004 | Durand | |
| 2004/0143998 | A1 | 7/2004 | Yang | |
| 2004/0194344 | A1 | 10/2004 | Tadin | |
| 2004/0194348 | A1 | 10/2004 | Campbell et al. | |
| 2004/0194352 | A1 | 10/2004 | Campbell et al. | |
| 2004/0221489 | A1 | 11/2004 | Hung | |
| 2004/0226114 | A1 | 11/2004 | Karasawa | |
| 2004/0226192 | A1 | 11/2004 | Geer et al. | |
| 2004/0255486 | A1 | 12/2004 | Pawlus et al. | |
| 2005/0034335 | A1 | 2/2005 | Shows | |
| 2005/0034338 | A1 | 2/2005 | Footman | |
| 2005/0050772 | A1 | 3/2005 | Miller et al. | |
| 2005/0076539 | A1 | 4/2005 | Klein | |
| 2005/0081405 | A1 | 4/2005 | Healy | |
| 2005/0086838 | A1 | 4/2005 | Khantzis | |
| 2005/0102771 | A1 | 5/2005 | Nguyen | |
| 2005/0138838 | A1* | 6/2005 | Lin et al. | 36/3 B |
| 2006/0080869 | A1 | 4/2006 | Johnson | |
| 2006/0096123 | A1* | 5/2006 | Grandini | 36/3 B |
| 2007/0062069 | A1 | 3/2007 | Durand | |
| 2007/0204484 | A1* | 9/2007 | Davis | 36/44 |

FOREIGN PATENT DOCUMENTS

| | | |
|---|---|---|
| EP | 0 287 662 | 10/1988 |
| EP | 0 528 130 | 2/1993 |
| EP | 0 571 730 | 12/1993 |
| JP | 3085101 | 4/1991 |

* cited by examiner

SECTION OF DRAINABLE SUPPORTIVE FIT IQ INSERT

WITH NARROW INSERT

WITH MEDIUM INSERT

WITH WIDE INSERT

2200

2300
2302
2302a
30.7mm
24.0mm
19.0mm
20.0mm
17.0mm
UP 1.0MM
21.0mm
18.0mm
27.0mm
2302b
2.0mm
2304
26.0mm
30.0mm
22.0mm
25.0mm
23.0mm
11.0mm
13.0mm
16.0mm
18.0mm
19.1mm
A 2308
2306
4.5mm
2.5mm
2.4mm 2.2mm
1.6mm
R 3.2mm
6.0mm
5.0mm
14.0mm
5.7mm

REPLACEMENT SHEET

29/29

2400'

EXTREME SERVICE FOOTWEAR

CROSS-REFERENCE TO RELATED APPLICATIONS

The present invention claims the benefit of the filing date of U.S. Provisional Patent Application No. 60/714,619, filed Sep. 7, 2005, and is related to U.S. patent application Ser. No. 11/206,237, filed Aug. 17, 2005 entitled "Footwear For Hostile Environments," to U.S. Provisional Patent Application No. 60/715,535, filed Sep. 9, 2005, and to U.S. patent application Ser. No., 11/517,083, entitled "High-Performance Boot," filed concurrently herewith, the entire disclosures of which are hereby expressly incorporated by reference herein.

BACKGROUND OF THE INVENTION

The present invention relates generally to articles of footwear and, more particularly, to footwear used by the military, law enforcement, or other personnel that confront a wide range of environments and circumstances. For ease of the reader, all the foregoing are collectively termed "military" hereafter. Of course, the footwear of the present invention is not limited to utilitarian functions but can be used in any footwear setting including, for example, routine footwear environments such as everyday footwear or fashion.

Military personnel require footwear that can provide increased protection and mobility in demanding environments, often while bearing heavy loads. These individuals spend a large amount of time standing or moving through all types of terrain all around the world and require footwear that can protect, support and assist them in traversing such terrain.

The primary function of footwear used by military personnel is to protect the wearer. For example, military personnel must be protected from rough terrain, snake bites, broken glass or shrapnel, and sharp objects such as knives.

A typical way to achieve this protection in past has been utilizing a leather upper and thick rubber outsole. These characteristics provide a small degree of protection to the wearer but also cause the footwear to become very heavy and restrictive. This increased weight contributes to wearer fatigue, especially over long periods of use. Because military personnel typically wear their boots for an entire day or more, heavy boots present a serious drawback for the wearer as they reduce his or her operational readiness.

In addition, conventional military boots fail to provide sufficient ventilation and drainage for the user's feet. This causes the user to become uncomfortable in hot or wet climates because the wearer's feet become very hot and the lack of ventilation does not allow moisture to escape the boot. This results in problems such as blisters, rashes, and infections.

Many military specialties have needs that go beyond conventional military units. For example, while convention military units use overwhelming numbers and firepower to vanquish battlefield opponents, special operators relay on stealth, surprise, speed and good intelligence. Special Forces operators are trained to perform extremely difficult, complex and/or politically sensitive missions on short notice, in peace and war time, anywhere in the world. Special Forces include land, air and maritime forces that can be employed as joint or single service units.

The strategic purpose behind Special Forces is threefold. First, they offer a range of options to decision makers confronting crisis and conflicts below the threshold of war, such as terrorism, insurgency and sabotage. Second, they are force multipliers for major conflicts, increasing the effectiveness & efficiency of the military effort. Third, they are forces of choice in situations requiring regional orientation, cultural and political sensitivity, including military-to-military contacts and noncombatant missions like humanitarian assistance, security assistance and peacekeeping operations.

Examples of U.S. Special Forces include the Army's Rangers, Green Berets, Delta Force, and $10^{th}$ Mountain Division, as well as Air Force Commandos, Navy Seals and the Marine Corps' Force Recon. Army Rangers are light-infantry forces that are primarily utilized in long range reconnaissance, intelligence gathering and long range patrolling. Green Berets are reconnaissance soldiers known for tactical and diplomatic skills, who are often utilized for liaison and training with friendly governments involved in counter insurgency operations, or as liaison and training advisors to members of insurgency forces. Delta Force may be utilized for missions requiring rapid response with surgical applications of a wide variety of unique skills, while maintaining a very low profile of U.S. involvement in, for example, hostage rescue, and special counter terrorism actions. Delta Force is well known as having some of the best marksmen in world. The $10^{th}$ Mountain Division specializes in mountain and artic warfare, and provides mountaineering skills with a combat dimension. Air Force Commandos may operate as air traffic combat controllers and pararescue jumpers as well as ground operators. Navy Seals are highly trained and work in sea, air and land environments. Navy Seals are masters of maritime operations, which include assault, combat diving and reconnaissance, and are fully capable of striking by sea and return by sea. Force Recon training is among the most intense and longest in the military, and these soldiers are trained to excel at many of the tasks that other Specials Forces units perform.

All of these Special Forces units require highly specialized training, equipment and gear to perform dangerous and sensitive missions as trained and expected. Such units operate in all types of environments such as air, sea, and land, which may include desert, mountain, jungle and urban settings. Specialized footwear capable of meeting the operational and environmental considerations of these environments is an important element of the required gear for units operating in such conditions.

Thus, there is a need for footwear which protects the wearer from various environments and hazards while providing a product appropriate for various terrains and activities. There is also a need for footwear adapted to meet the rigorous demands of Special Forces and other units that operate using stealth, surprise, and speed. In addition, many activities and conditions require military personnel to operate while on the hands, feet, knees, back and/or stomach. It is highly desirable for military-type footwear to provide traction, support and comfort when in any of these positions.

The present invention addresses these and other needs. The present invention provides an ideal military boot through combinations and juxtapositions of various features and characteristics as will be described herein.

SUMMARY OF THE INVENTION

The present invention provides footwear that meets the performance needs of diverse military operations with a wide range of performance and terrain challenges. Unique protection and traction features on articles of footwear are provided. The present invention provides footwear outsoles that reduce noise during use, promoting stealth upon surface contact. The present invention also provides improved outsole, midsole and footbed constructions in footwear that has the support required for bearing heavy loads, incorporates drainage elements for improved performance and comfort, and also provides underfoot protection from objects and punctures. The present invention also provides specialized adjustable footbeds that allow the user to adjust the fit of the shoe in order to improve comfort, reduce relative footwear movement against the foot, and provide a means of adjustment for different weather conditions. The present invention also provides improved protection in the upper.

In accordance with one embodiment of the present invention, an article of footwear is provided. The article of footwear comprises an outsole, an upper, a bootie, a footbed and cartridge system, and a rand. The outsole has a first surface and a second surface remote from the first surface for contacting the ground and having lugs thereon. At least some of the lugs are wraparound lugs disposed along the perimeter of the outsole. The upper is attached to the first surface of the outsole and has an interior surface defining a cavity for receiving a foot and an exterior surface of a puncture resistant material. The interior surface has at least one of microbial and chemical protection thereon. The puncture resistant material includes finger projections directed towards the anterior of the upper for enhanced securing of the foot. The bootie is disposed at least partly within the cavity of the upper for enclosing the foot. The finger projections extend over the bootie. The footbed is disposed within the cavity of the upper and has a forefoot region and a heel region including a stiffening member. The footbed includes at least one drainage hole therein. The cartridge includes a fastening mechanism for releasably connecting to the forefoot region of the footbed. The cartridge also includes at least one drainage hole therein that aligns with the at least one drainage hole of the footbed. Finally, the rand is disposed along a portion of the exterior surface of the upper. The outsole is made from a high traction brushed rubber.

In accordance with another embodiment of the present invention, an article of footwear is provided with wraparound outsole lugs, a puncture resistant upper, ankle protection and a traction-promoting rand. In particular, the outsole has a first surface and a second surface remote from the first surface for contacting the ground and having lugs thereon. At least some of the lugs are wraparound lugs disposed along the perimeter of the outsole. The upper is attached to the first surface of the outsole. The upper has an interior surface defining a cavity for receiving a foot of a wearer and an exterior surface of a puncture resistant material. An ankle protection member is disposed along at least one of the medial ankle region and lateral ankle region of the upper. The rand is disposed along at least a heel portion of the exterior surface of the upper, and comprises a high traction brushed rubber.

In one alternative, the ankle protection member comprises an inner cushioning layer and an overlay. The inner cushioning layer has a first surface facing the cavity of the upper and a second surface facing away from the cavity. The overlay is disposed adjacent to the second surface of the inner cushioning layer and is operable to dissipate impact forces applied to the medial or lateral ankle regions of the article of footwear.

In another alternative, the puncture resistant material includes finger projections directed towards the anterior of the upper for adaptive securing of the foot within the cavity. Here, the article of footwear may further comprise a bootie for enclosing the foot within the cavity of the upper. In this case, the finger projections may extend at least partly over the bootie.

In a further alternative, the lugs further include a plurality of finger lugs and a plurality of angled lugs arranged in at least one of the forefoot and heel sections of the second surface of the outsole. In this case, the plurality of angled lugs are preferably disposed in rows running along the medial and lateral sides of the second surface of the outsole. Here, the plurality of finger lugs are disposed between the rows of angled lugs.

In yet another alternative, the wraparound lugs include medial and lateral side wraparound lugs. In another alternative, the wraparound lugs include a heel wraparound lug disposed over a heel section of the article of footwear. The heel wraparound lug preferably includes a plurality of ridges therealong.

The article of footwear may further comprise a footbed and a cartridge releasably connected to the footbed. In this case, the cartridge may be selected to provide a predetermined volume in the cavity for receiving the wearer's foot. Optionally, the interior surface of the upper may include at least one of microbial and chemical protection thereon.

In accordance with a further embodiment of the present invention, an article of footwear is provided with liquid drainage capability. Specifically, the footwear comprises an outsole having a first surface and a second surface remote from the first surface for contacting the ground and having lugs thereon, as well as an upper attached to the first surface of the outsole. The upper has an interior surface defining a cavity for receiving a foot of a wearer and an exterior surface opposite the interior surface. A toe portion of the footwear is disposed along the toe region of the cavity. The toe portion includes at least one drainage hole operable to discharge liquid from the cavity of the upper to the external environment. A footbed is disposed within the cavity of the upper and has a forefoot region and a heel region. The footbed includes at least one drainage hole therein for draining the liquid away from the wearer's foot and to the drainage hole of the toe portion.

In one alternative, the at least one drainage hole is a one-way drainage hole. In another alternative, the article of footwear further comprising at least one removable drainage plug disposed on the at least one drainage hole. In yet another alternative, the article of footwear further comprises a cartridge including a fastening mechanism for releasably connecting to the forefoot region of the footbed. The cartridge also includes at least one drainage hole therein that aligns with the at least one drainage hole of the footbed.

In another alternative, the article of footwear further comprises a support saddle connected to at least the heel region of the footbed. The support saddle includes medial and lateral sidewall members therealong. In one example, the support saddle includes a heel receptacle and the heel region of the footbed includes a cushioning member adapted to fit the heel receptacle. The support saddle may also include a contoured instep region operable to permit fastening of different sized cartridges to the forefoot region of the footbed.

In a further alternative, the footbed includes a puncture resistant layer. In yet another alternative, the lugs are sound reducing non-planar lugs. In another alternative, the outsole is a low profile outsole of less than 4 mm thickness. In this case, the article of footwear may further comprise a midsole coupling the upper to the outsole. The midsole is most preferably a low profile midsole of less than 4 mm thickness. The low profiles of the outsole and midsole provide enhanced stability to the wearer.

DETAILED DESCRIPTION

An article of footwear such as a military boot will now be described with reference to the figures according to a preferred embodiment of the invention.

Figure 1:
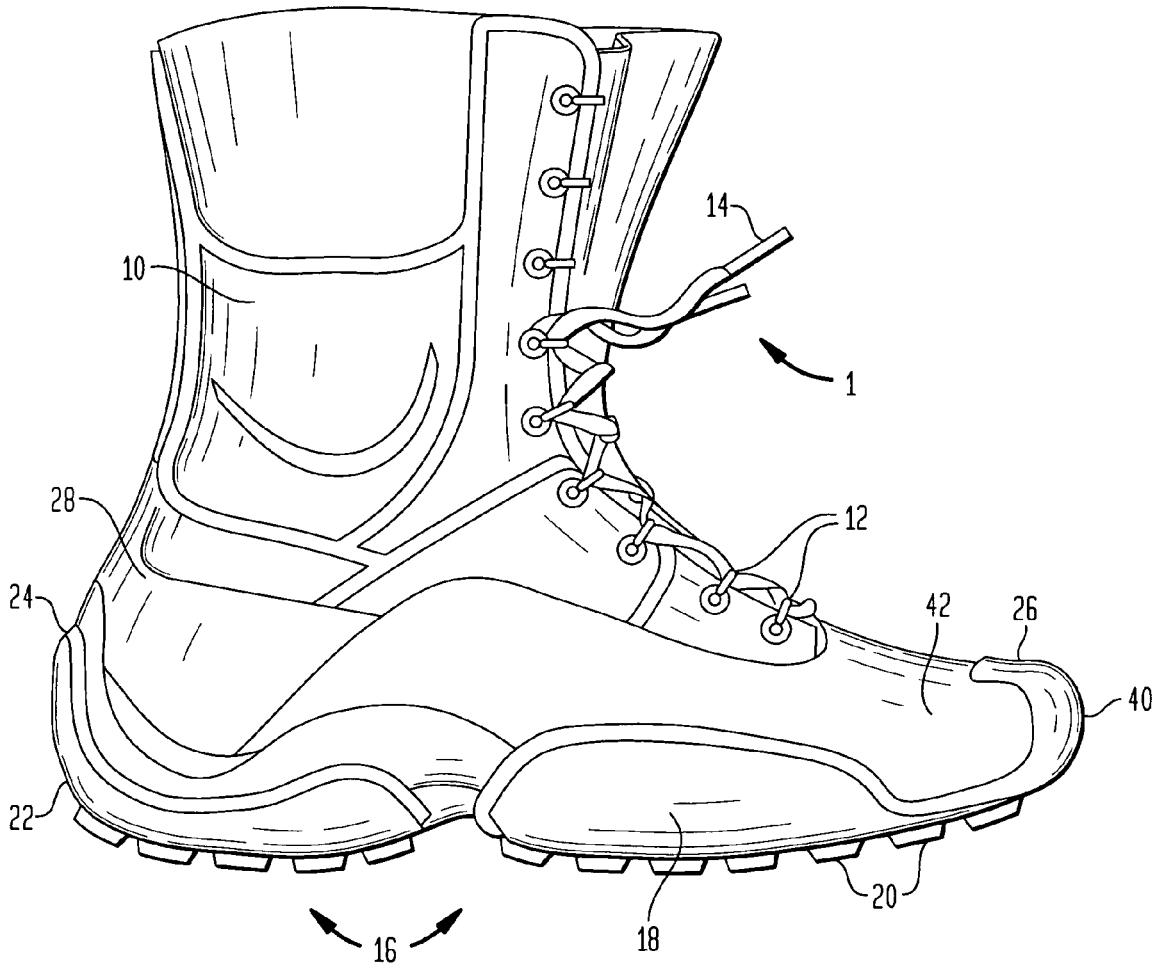
FIG. 1 is a side view of an article of footwear according to a preferred embodiment of the invention.

FIG. 1 illustrates an article of footwear 1. The article of footwear 1 illustrated in a boot configuration; however, other styles and configurations are possible. The boot 1 preferably includes an upper 10 defining a cavity adapted to receive a wearer's foot. The upper is flexible, meaning the material that makes up the upper easily bends to allow the wearer's ankle to move freely while secured within the boot. The upper 10 may be constructed of various segments of different materials which may be sewn or otherwise attached together or may be integrally formed as a single piece.

The upper 10 is preferably made of a lightweight puncture and cut resistant material. The puncture resistant upper 10 may fully resist punctures. It preferably also can absorb an impact inducing force by yielding but not breaking in response to the force. Thus, the upper 10 desirably for all but the strongest forces will not fully yield so as to break the integrity of the upper 10 at the side proximate to the foot of the wearer. The puncture resistant upper 10 prevents sharp objects that are thrust toward the footwear from contacting the foot or ankle of the wearer. In a military situation, this material may shield the wearer's foot from knives, broken glass, shrapnel, or other sharp objects. By way of example only, the upper 10 may include high-strength materials such as aramid fibers. Para-aramid fibers, which have a slightly different molecular structure from aramid fibers, also provide outstanding strength-to-weight properties, high tenacity and high modulus. DUAL MIRROR® by Gentex is an aluminum and aramid laminate used for extreme flame and heat protection. NOMEX® or KEVLAR brand fibers from E. I. Du Pont de Nemours and Company are aramid blends that include the flame and heat resistance in a plain weave or rip stop material. Treated materials, such as leather or synthetics can be finished with a puncture and/or cut resistant finish. Tightly woven aramids or para-aramids such as E.I Du Pont de Nemours and Company's SNAKE ARMOR can be employed for fire resistance and added puncture resistance. The material(s) of the upper 10 may also be made up of layered, densely woven fabrics to prevent puncture as disclosed in U.S. Pat. No. 6,720,277, the entire disclosure of which is hereby incorporated by reference herein. In another example, the material used for the upper 10 may be made cut and puncture resistant by utilizing a material composed of platelets and rivets as disclosed in U.S. Pat. No. 6,159,590, the entire disclosure of which is hereby incorporated by reference herein. The aforementioned materials, as known to those skilled in the art, provide protection to the wearer of the boot 1 from puncture or cuts from sharp objects or abrasive materials.

The upper 10 is preferably made of a material that is sufficiently flexible to allow the wearer to easily move their ankle or other portion of the leg or foot with very little resistance. This upper flexibility reduces stress on the ankle and leg muscles of the wearer and promotes comfort. Flexibility may be derived in multiple ways, including not only the upper material, but may also be derived from structural integration of pleats, grooves, or other known structures into the upper 10 that enhance flex.

The material used for the upper 10 may also include a flame retardant material, including some of the materials discussed above, such as DUAL MIRROR and SNAKE ARMOR, as well as TURTLESKIN brand synthetic fiber which is manufactured by Warwick Mills. By way of example only, the flame retardant upper 10 will protect the wearer if the wearer is forced to enter a burning building in an emergency situation or if the user must traverse terrain that is on fire.

The upper 10 may also be waterproof to allow the wearer to traverse a particular depth of water without allowing water to enter the cavity portion of the boot 1 wherein the foot is placed. This will be useful to the wearer if the wearer walks through rivers, swamps, snow, or other wet terrain. The upper 10 is preferably also hydrophobic, meaning that it does not retain water. This helps to reduce the overall weight of the boot 1 by preventing it from becoming water logged, thereby reducing wearer fatigue due to lifting heavy footwear. Materials such as hydrophobic expanded polytetrafluroethylene ("PTFE"), commonly sold under the mark GORE-TEX®, or EVENT brand materials manufactured by BHA Technologies, Inc. are known in the art that individually or in combination are waterproof or hydrophobic.

The upper 10 may also include protection against harmful microbes or chemicals. The protection may be incorporated into the upper 10 and elsewhere in the article of footwear. For instance, known materials or compounds resistant to microbes such as AgION antimicrobial compounds by Agion Technologies, Inc. may be utilized. Also, compounds or compositions known to be resistant to certain chemicals such as acids or bases may be utilized. Alternatively, and by way of example only, the upper 10 may include a layer of trapping material which traps harmful microbes and prevents them from contacting the wearer's foot.

Alternatively, the upper 10 may be made of a plurality of layers, each layer comprising materials as described herein that enhance the comfort and protection of the wearer. The layers are adhered or otherwise attached to each other for a symbiotic or synergistic effect. The upper 10 may have, for example, a waterproof outer layer, furthest from the foot, with a puncture proof inner layer. The ordering of the layers may be implicated by the particular footwear function envisioned. A firefighter boot where water is commonly encountered may have as an outer layer waterproof material followed by one or more additional layers, as compared to a military boot which may have puncture resistant material at its outer layer. The various layers may partially or completely overlap each other.

Figure 18:
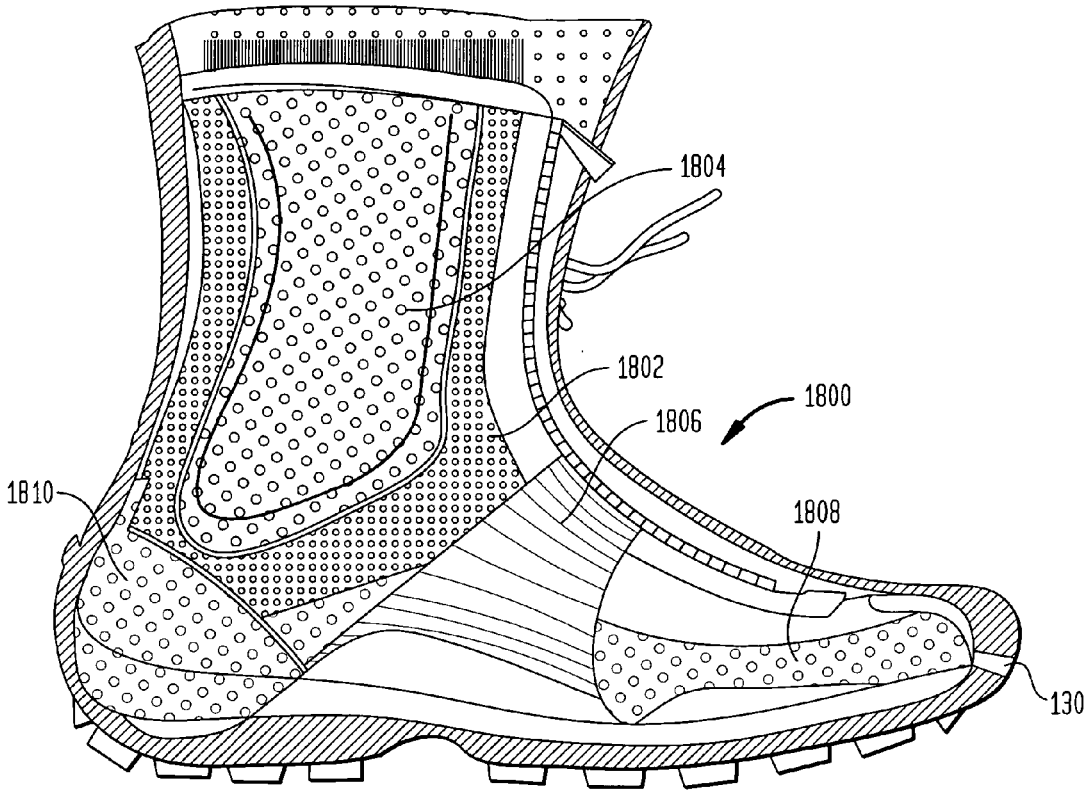
FIG. 18 is a cutaway view of one embodiment of an article of footwear according to the present invention showing the inner bootie.

The upper 10 may also have a booty or inner upper structure placed inside of the upper 10 for comfort, fit, breathability and/or drainage. The booty may comprise a stretchable synthetic material such as a mesh, neoprene, or a molded ethyl vinyl acetate ("EVA"). The booty may be perforated for enhanced drainage. A booty 1802, as shown in cutaway view FIG. 18, may be made of any of the aforementioned materials to provide the functions set forth above. The booty 1802 may be formed of a single material or a combination of materials to enhance comfort and performance. For example, the materials of the booty 1802 can possess one or more characteristics of water resistance, heat resistance, flame retardance, microbe resistance, and/or acid/base resistance. In a preferred example, the booty 1802 is desirably formed of a neoprene material and/or a perforated material such as perforated EVA panels. The booty 1802 preferably resides inside the cavity of the boot 1800. The booty 1802 may have an ankle region 1804 which may have a cushioning material, such as perforated foam, for breath ability, cushioning and comfort. The ankle region 1804 may be, for example, thicker than the rest of the booty 1802 to provide extra padding to the ankle bone of the wearer. The booty 1802 may also have an elasticized security strap 1806 in the forefoot region for in shoe security. A lower portion 1808 and a heel portion 1810 may be made of, for example, perforated molded EVA or other materials for protection, comfort, durability, breathability and drainage. The portions 1804, 1808 and 1810 may all be made with the same material(s), such as a puncture proof mesh.

Returning to FIG. 1, the upper 10 not only provides advanced protection against cuts and punctures, but also is lighter than traditional leather uppers known in the art. Through the use of fabrics that incorporate resin guard plates like SUPERFABRIC brand materials and leathers by HDM, Inc. of Oakdale, Minn., the upper 10 can be made stronger and more puncture resistant than conventional leathers and synthetics. The upper 10 also requires no time to soften or yield as leather does. This enables the wearer to put on the boot 1 and be ready for action without delay and with little break-in period.

The upper 10 is preferably ventilated to allow air to flow between the cavity of the boot 1 and the outside environment for the wearer's comfort. This keeps the wearer's feet cool in hot environments. A plurality of configurations are available to ventilate the boot 1. One configuration comprises a chimney structure that allows air to escape from the lower portion of the boot through a chimney structure in the tongue and/or side of the boot, as described in U.S. patent application Ser. No. 11/432,232, entitled "Chimney Structures for Footwear and Foot Coverings," the entire disclosure of which is hereby incorporated by reference herein. In another embodiment, the fabric that makes up the upper 10 of the boot 1 is itself breathable, meaning that there are small ventilation holes in the fabric itself to allow air to enter and escape the inside of the boot 1. For example, the fabric may comprise one or more layers of a breathable mesh.

Returning to FIG. 1, the upper 10 of the boot 1 preferably has a number of eyelets 12 attached thereto, which may be, for example, plastic, rubber or metal. The eyelets 12 allow boot laces 14 to be inserted therethrough to allow quick lacing and security that will comfortably and adjustably hold the boot 1 on to the foot and ankle of the wearer. Alternative attachment mechanisms such as straps can also be employed.

The boot 1 preferably has a flexible outsole 16 which most preferably has a high traction characteristic such as is achieved using a high-traction rubber or other material known to enhance traction. The outsole 16 preferably covers the majority of the bottom of the boot 1 that routinely is in contact with the ground and may extend partially up the sides of the upper 10, as seen with side portion 18 and heel portion 22 of the outsole 16. The side portion 18 and the rounded heel of the outsole 16 provide extra protection, support and traction on rough terrain for the wearer of the boot 1 in certain conditions, such as deep mud, snow, loose gravel, rock, etc. The side portion 18 and the rounded heel 22 may also provide extra traction, for example, when the wearer is rappelling down the side of a building or other structure or a mountain or other challenging terrain, when the wearer is crawling on the ground, when the wearer is engaging in ground combat, etc. Here, medial and lateral sides of the boot 1 as well as the heel region may come into contact with such structures or terrain.

The outsole 10 of the boot 1 is preferably sealed to the upper 10 with a water-tight sealant that inhibits water from entering the boot 1. This is important to maintain the waterproof nature of the boot 1 when a water-proof upper 10 is used. The sealant is preferably flexible to allow movement of the boot 1 without breaking the seal.

The outsole 16 of the boot 1 is preferably made of a high-traction rubber or other material. The high traction rubber desirably has a coefficient of friction greater than that for typical rubber outsoles. Preferably, a rubber formulated for increased traction may have a softer rubber compound that provides a better grip, e.g., a range of 5-10 hardness points lower than standard rubber, as measured in Shore A. By way of example only, a standard rubber may measure approximately 58 Shore A, while a high traction rubber may measure approximately 48-53 Shore A. In another example, the high traction rubber is less than about 55 Shore A. The high traction of the rubber or other material allows the outsole 16 of the boot 1 to provide superior grip on all manner of surfaces. The outsole 16 may comprise a layer of EVA foam with a layer of high-density rubber on the outside. The EVA foam can be selected to have a predetermined level of cushioning and/or hardness.

The outsole 16 preferably includes a plurality of lugs 20 to provide additional traction. The lugs 20 are preferably low-profile, that is of low height, to reduce the overall height of the outsole 16 and provide a lower center of gravity for the boot 1. This provides more stability for the wearer of the boot 1. Alternatively, at least some of the lugs may be articulating lugs such as those described in U.S. Patent Publication No. 2005/0081405, the entire disclosure of which is hereby incorporated by reference herein.

The lugs 20 are preferably also configured so as to reduce the amount of sound emitted by the boot 1 while the wearer is walking. This is especially advantageous in certain military situations in which the wearer is trying to avoid detection, such as stealth missions. The lugs' shape, material type and material hardness all contribute to the sound produced during the impact of the outsole on a surface. For instance, a lug with a substantially parallel or planar surface will produce an impact sound of a higher decibel rating than a lug that is not parallel or planar with the surface. By way of example only, a large flat lug will produce more sound than an angled or pointed lug. The entire surface of a large flat lug comes into contact with the ground at approximately the same time, and, therefore, "slaps" the ground, producing relatively more noise than an angled, rounded, pointed, dimpled or otherwise substantially non-planar lug that comes into contact with the surface more gradually or otherwise reduces the amount of air displaced by the lug when contacting the ground. The gradual or reduced air displacement reduces peak decibel levels as compared with a flat lug.

Figure 7A:
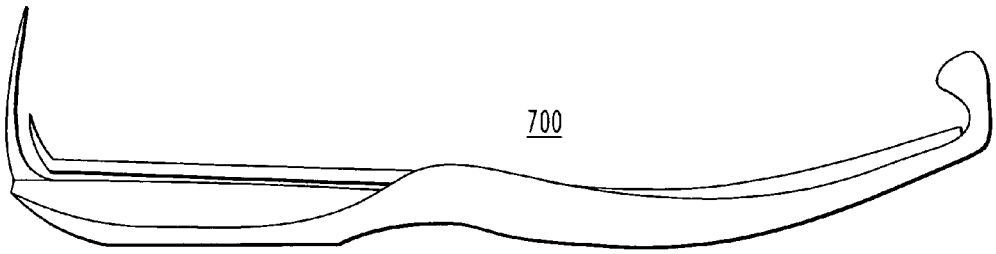
FIGS. 7A and 7C depict side views of outsoles which may be used in accordance with aspects of the present invention.
Figure 7B:
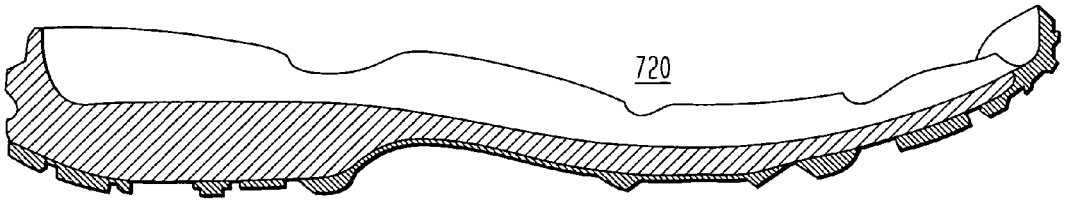
FIG. 7B (PRIOR ART)
FIG. 7B depicts a conventional outsole.
Figure 7C:
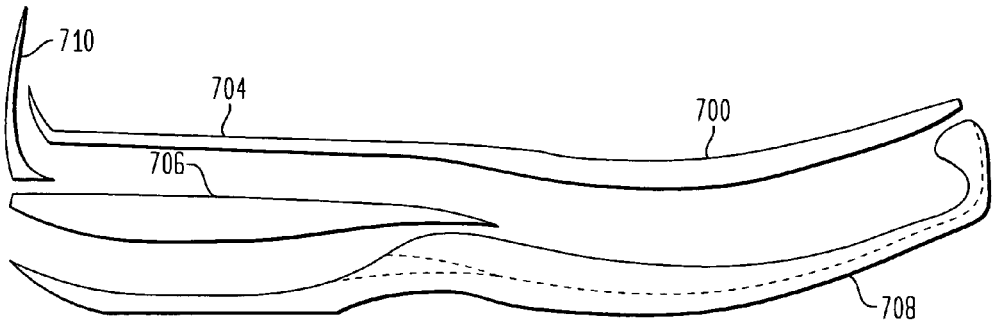
Figure 8D:
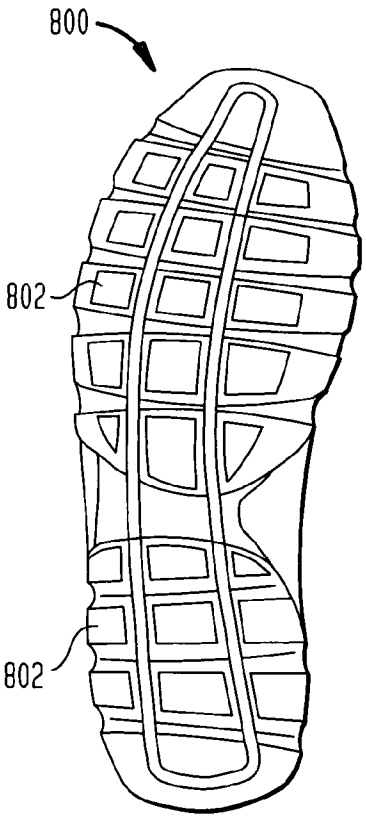
FIGS. 8A-8D depict bottom views of outsoles which may be used in accordance with aspects of the present invention.
Figure 8C:
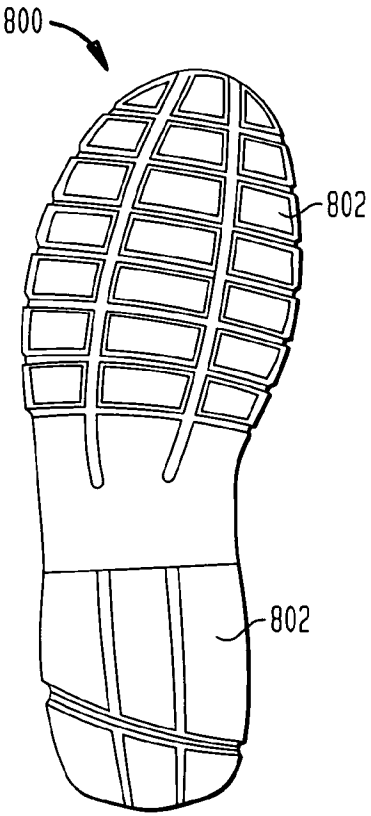
Figure 8B:
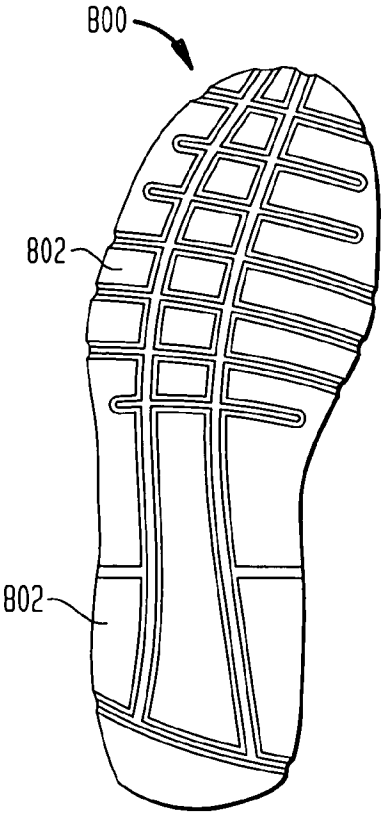
Figure 8A:
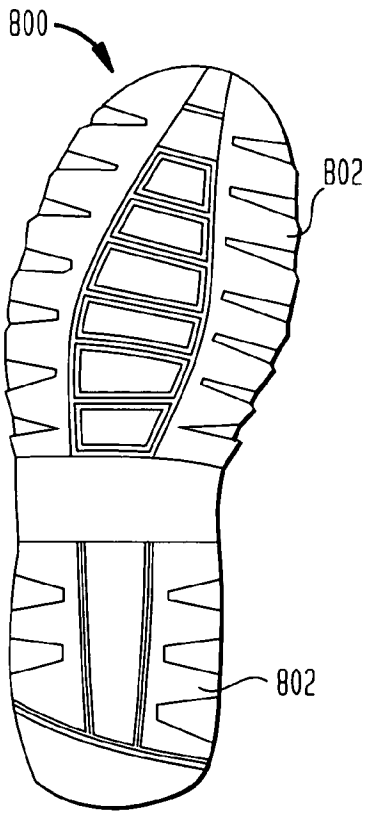

In addition, the entire outsole 16 and midsole (not shown) may be made low-profile to further enhance stability. This low-profile outsole and midsole combination preferably provides the same protection to the foot of the wearer as conventional outsole and midsole combinations. FIG. 7A depicts a low-profile outsole and midsole combination 700 according to one embodiment of the invention. A conventional outsole and midsole combination 720 is shown in FIG. 7B for comparison. The outsole and midsole of the combination 720 are typically made of thick rubber. FIG. 7C shows an exploded view of the outsole and midsole combination 700 according to the present invention. The combination 700 preferably comprises a low-profile footbed 704 of, e.g., EVA or PU, a low-profile midsole 706 of EVA, PU or the like, and a low-profile outsole 708 of, e.g., rubber. The combination preferably also comprises a rand 710. The midsole 706 and footbed 704 are both preferably thinner than conventional midsoles and heel pads to further reduce the distance of the wearer's foot from the ground, giving the wearer greater stability. In one embodiment, the footbed 704 is 6 mm at its thickest portion and 1.5 mm at its thinnest portion. Preferably, the footbed 704, the midsole 706 and/or the outsole 708 are each 4 mm thick or less, such as about 2-3 mm thick.

Returning to FIG. 1, the outsole 16 may have a rounded heel 22. The rounded heel 22 is preferably gradually rounded in the direction from the bottom of the outsole 16 to the back of the upper 10. The rounded heel 22 preferably has lugs 20 extending partially therealong. The rounded heel 22 provides enhanced traction to the wearer when the toe of the foot is tiled upwardly, which may occur in mountainous or other non-planar terrain, or when the soldier is on his or her back.

The heel 22 may also have a ridge or ledge 24 at the top thereof which allows the user to easily remove the boot 1 by placing one foot in front of the other and placing the toe of the rear foot on the heel ridge 24 of the boot 1 on the front foot, thus creating an opposite force from the leg force pulling the foot out of the boot 1. The ridge 24 preferably extends outwardly from the rear of the boot 1 by about 2-3 mm. The ridge may also provide the wearer with additional traction in some environments. The ridge is preferably made of a rubber or other pliable material, but may also be made of a rigid material such as plastic.

As depicted in FIG. 1, the outsole 16 may also wrap upwardly over the toe portion 40 of the boot, forming a toe protector 26 preferably over the toe box 42 of the boot 1. However, the toe protector 26 need not completely cover the toe box 42, but can be, for instance, over only one or several toes depending upon the intended use of the footwear or other considerations such as fashion. Toe protector 26 provides extra protection for the toes of the wearer if, for example, objects are dropped on the wearer's feet. The toe protector 26 also provides more rigidity for the front of the boot 1 if the wearer needs to kick hard objects with the boot 1. The toe portion 40 may have one or more ridges (not shown) included thereon for additional traction in the front portion of the boot 1.

The toe protector 26 may be formed of the same materials as the rest of the outsole 16, such as EVA, polyurethane, rubber or other materials commonly used in outsoles. The toe protector 26 may also comprise or be reinforced using steel, ceramics, plastics or other materials. Alternatively, the toe protector 26 may include a combination of any of the aforementioned materials in any combination. The toe protector 26 may be integrally formed with the rest of the outsole 16 or may be attached thereto during fabrication.

Figure 4:
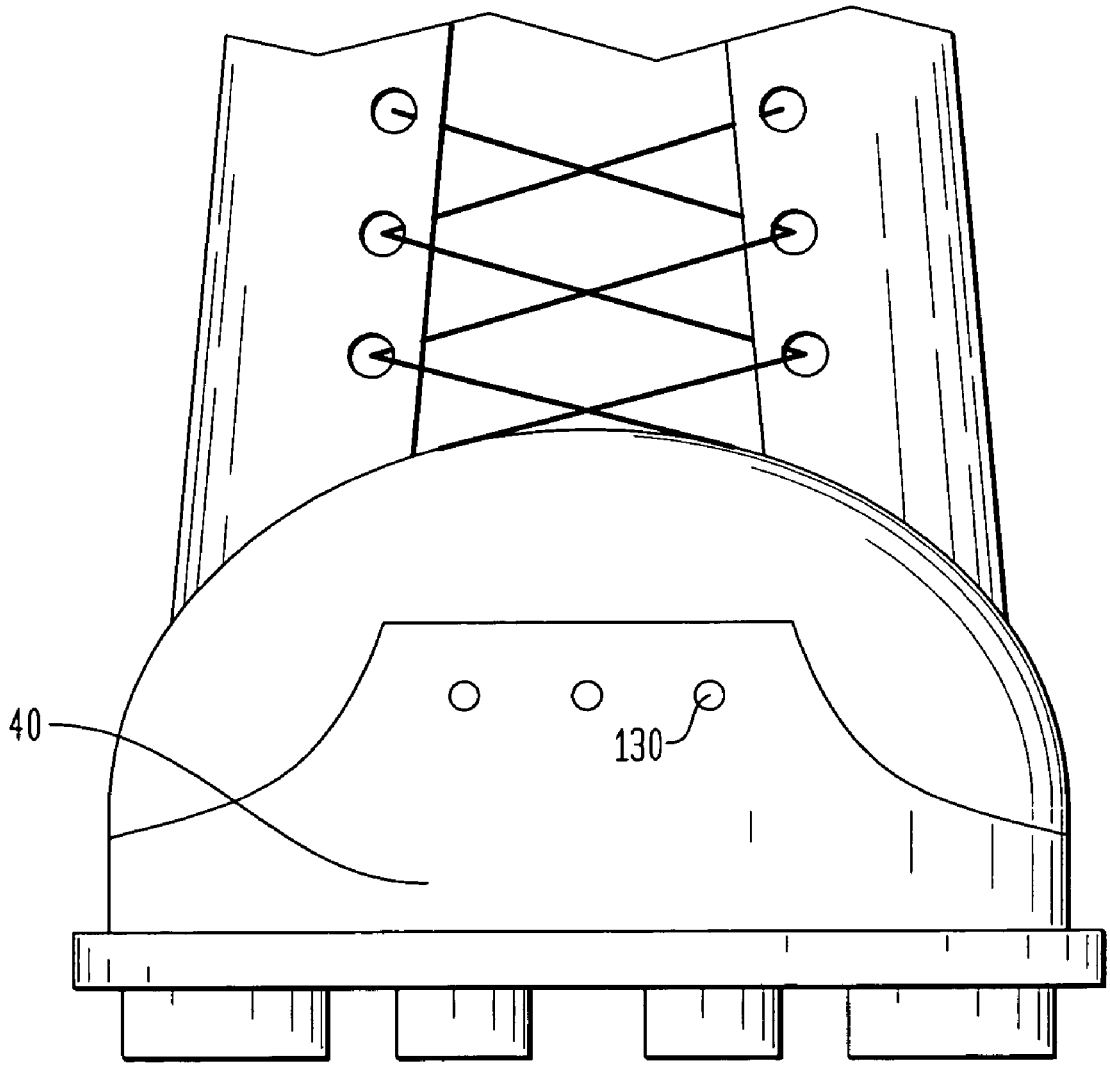
FIG. 4 is a front view of an article of footwear having drainage holes in the forefoot region according to a preferred embodiment of the invention.

As shown in FIG. 4, the toe portion 40 of the boot 1 may have one or more drainage holes 130, which are preferably placed in the outsole 16. The toe portion 40 preferably has a plurality of drainage holes 130, such as two to four drainage holes 130. The boot 1 may also have drainage holes (not shown) in the heel portion, arch portion, or elsewhere along the outsole 16. Three drainage holes 130, whether in the toe, arch, heel, etc. may be optimum, although the exact number may depend on factors such as the size of the boot 1, intended end use or fashion. These holes may be one-way drainage holes 130 such that any liquid that has gathered in the inside of the cavity or interstitial spaces of the boot 1 can be drained out of the toe box 42 of the boot 1 without allowing any liquid to enter the front of the boot 1. For example, the one-way drainage holes may be of the kind shown and described in U.S. Pat. No. 6,681,500, entitled "Vapor-Permeable Waterproof Sole for Shoes" and U.S. Pat. No. 6,874,251, entitled "Waterproofed Vapor-Permeable Sole for Shoes," the entire disclosures of which are hereby incorporated by reference herein. In use, if the user has detected that water has gathered inside the boot 1, the user may pick up his foot and point his or her toes (or heel) towards the ground. Any liquid that may have gathered within the cavity or interstitial spaces of the boot 1 will flow downward or be directed toward the toe, heel, arch or any other location of the boot 1 and exit through the drainage holes 130. Once the liquid has drained, the user can return to normal use of the boot 1.

The position of the drainage holes 130 relative to the rest of the boot 1 is important. Holes 130 that are placed higher on the boot 1 that allow for draining based on the user changing the orientation of the boot provide a unique opportunity to keep the interior of the boot 1 relatively dry while still allowing for drainage. For instance, holes 130 positioned at the high spot on the toe keep the boot 1 above the water line of the majority of wet areas and prevent water from coming into the holes 130, such as during normal walking conditions. If water does enter the boot 1, for example from the top of the collar, changing orientation, e.g., pointing the toe down, enables the user to drain the boot 1.

Alternatively, the drainage holes 130 may be predisposed to allow more water out of the boot 1 than they let in. While not completely waterproof, this method provides drainage and, at least, some protection against wet environments. This can be achieved by molding drainage holes that are funnel shaped with the large end of the funnel facing the interior of the boot 1. The large end of the funnel serves as a reservoir to collect water present in the boot 1 and evacuate the water through the small end of the funnel. Water on the outside of the boot 1 will be less likely to enter the boot 1 since the surface area of the hole exposed to the outside environment is reduced.

Figure 14A:
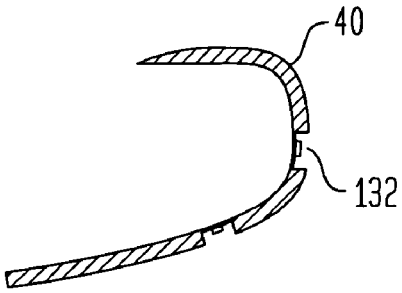
FIGS. 14A-14D depict partial cross section views of embodiments of outsoles for articles of footwear according to the present invention.
Figure 14C:
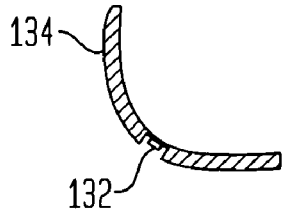
Figure 14B:
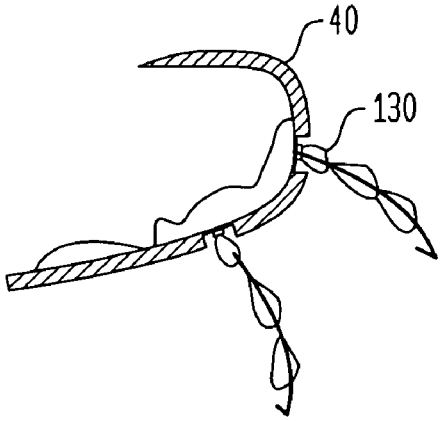
Figure 14D:
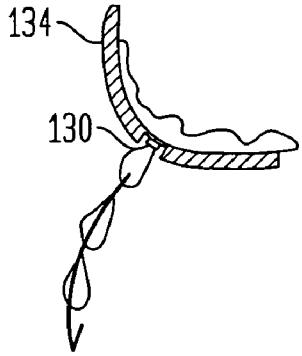

A plurality of views of the drainage holes are presented in FIGS. 14A-14D. FIG. 14A shows a partial cross section of a toe portion 40 of the boot 1 with drainage plugs 132 located therein. The plugs 132 may be removed, which allow water that has gathered in the cavity of the boot 1 to drain out of the drainage holes 130 as depicted in FIG. 14B. FIG. 14C shows a partial cross section of an arch portion 134 of the outsole 16 with a drainage plug 132 inserted therein. Once the drainage plug 132 is removed, water escapes through drainage holes 130 in the arch portion 134. Of course, it should be understood that the drainage holes 130 and plugs 132 may be positioned along the toe, arch, and/or heel regions, or elsewhere on the outsole 16. The plugs may be single use or reusable plugs. Single use plugs 132 may be knocked out, cut out, dug out, or otherwise removed by the user and discarded. Reusable plugs 132 can be stored for later use. Alternatively, the plugs 132 may include adjustable spigots that can be opened to allow water to drain out and then closed to prevent water, debris or other matter from entered into the boot 1 through the drainage holes 130.

In an alternate embodiment, the drainage holes 130 may drain liquid that has accumulated between different layers within the upper 10. For example, if the boot 1 has a neoprene bootie such as the bootie 1802, the neoprene bootie prevents the liquid from entering the cavity where the wearer's foot resides. Liquid may gather, however, between the neoprene booty and the outer layer or layers of the boot 1. This liquid will then be drained out of the drainage holes 130.

The outsole 16 may have a plate (not shown) inserted into or overlying the outsole 16. Alternatively, a plate may be positioned on top of the side of the outsole 16 adapted to receive the wearer's foot and beneath a footbed or insole 30. The footbed 30 preferably comprises polyurethane ("PU") or EVA foam, or any other known footbed material. In a further embodiment, the steel or other puncture resistant plate may be incorporated below the footbed 30. The plate is preferably positioned and adapted to allow the user to easily replace the plate if it becomes compromised in any way. The plate preferably comprises KEVLAR which is lightweight and flexible, other aramid or aramid blends, or steel or similar metals. The plate may extend the entire length of the boot 1 but preferably covers at least the shank portion of the boot 1. The plate is useful in providing protection from punctures coming from sharp objects that may be trodden upon. For example, if the user steps on a nail that is sticking up, the plate will prevent the nail from puncturing the foot of the user. The plate also provides rigidity to the boot 1 to prevent overextension of the outsole 16 if the wearer spends a large amount of time on terrain that contacts the mid-portion of the outsole 16, such as rebar, ladders, etc. Additional materials can be used such as nylon, polyurethane and thermoplastic. The plate or plates can also be used to enhance sole stiffness especially useful for the wearer on hard uneven terrain where balance is critical. The plate may be, for example, an aramid or aramid blend, e.g., KEVLAR. Alternatively, a KEVLAR sheet may be combined with one or more layers of TPU or other footbed materials.

Returning to FIG. 1, the boot 1 may further comprise a rand 28, a wrap around protective covering on the upper 10. The rand 28 may connect the upper 10 with the outsole of the boot 1 in a water-tight fashion. The rand 28 may be integrally formed with the outsole 16 and/or the upper 10. Preferably, the rand 28 comprises protective rubber, or other materials commonly used in shoes. The rand 28 may be made of the same material as the upper 10, the outsole 16, or may be made of a different material altogether. The rand 28 may also be made, for example, from an aramid material, or a heat resistant and flame retardant finished leather, rubber or thermoplastic material. Any material such as leather, synthetic, rubber, plastic, treated or untreated, etc. may be used. The rand 28 may be reinforced with a rigid member contained within the cavity of the boot, such as a steel, KEVLAR, or ceramic member. This rigid member provides support to the boot 1 and also provides protection to the foot of the wearer from impact and puncture.

Figure 2:
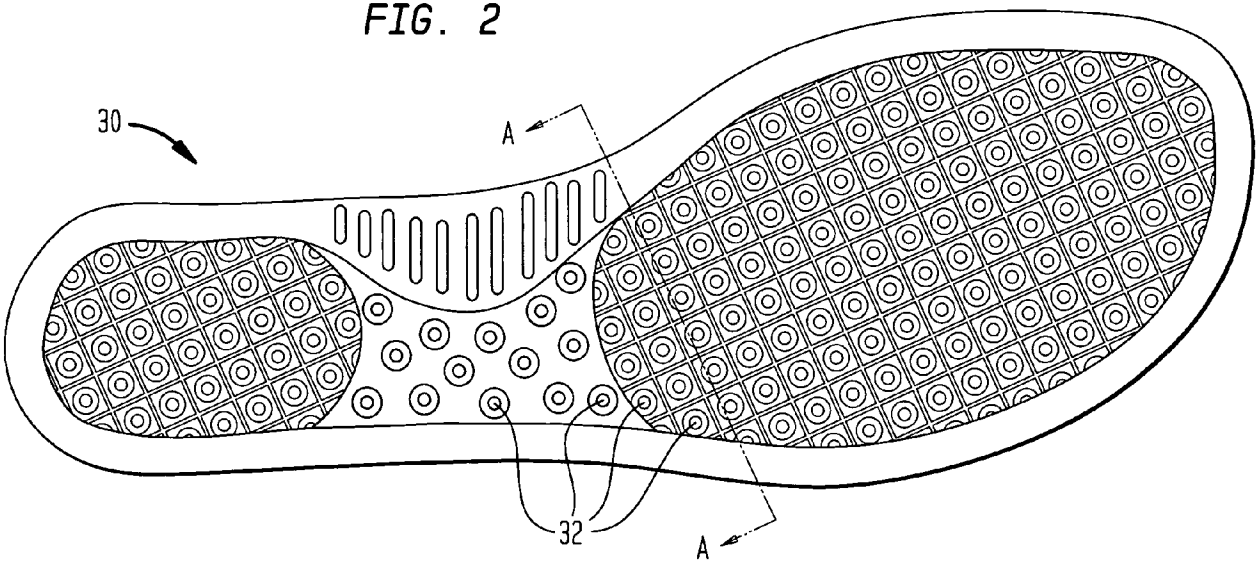
FIG. 2 is a bottom view of a footbed according to a preferred embodiment of the invention.

FIG. 2 shows the insole or footbed 30, which may be added as a component of the boot 1. Preferably, the footbed 30 is positioned within the upper 10 over the outsole 16 and above the midsole (not shown). The footbed 30 may be removable from the upper 10 or may be permanently, securely affixed on the article of footwear 1 using an adhesive or other bonding agent. Alternatively, the footbed 30 may be integrally formed as part of the outsole 16 or midsole. The footbed 30 preferably comprises perforated PU and has a plurality of drainage holes 32 that allow water or moisture that has accumulated inside the cavity of the boot 1 to drain through the footbed 30. The drainage holes 32 may be of any shape and size. The drainage holes 32 preferably are large enough to allow water to drain yet small enough to not inhibit the cushioning properties of the footbed 30. The drainage holes 32 may also allow air to flow between the outside environment and the cavity of the boot, which provides ventilation and thus added comfort to the wearer's foot.

The footbed 30 may be formed of one or more material layers, regions, and/or segments, which may each have a different thickness and/or a different rigidity. For example, the footbed 30 may comprise multiple layers of different rigidity. Alternatively, the footbed 30 may have different levels of rigidity in the forefoot, instep, and heel regions, respectively. The footbed 30 could also have a first segment about the first metatarsal on the medial side of the forefoot of a first rigidity and a second segment about the fifth metatarsal on the lateral side of the forefoot of a second rigidity.

Figure 2A:
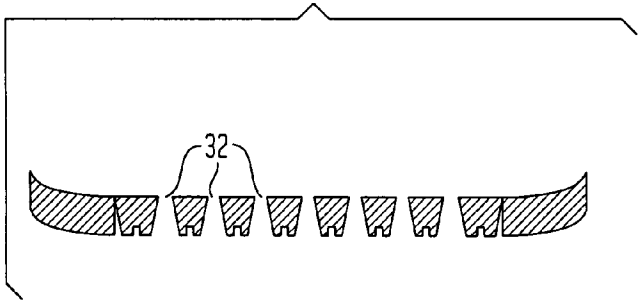
FIG. 2A is a cross-section view of the footbed depicted in FIG. 2.

FIG. 2A shows a cross-section of the footbed 30 taken along the A-A line of FIG. 2, showing a cutaway view of the drainage holes 32. The drainage holes 32 are preferably tapered toward the top of the footbed 30 to allow easy drainage of water through the footbed 30 while still providing sufficient support on the top of the footbed 30 for the wearer.

Figure 6:
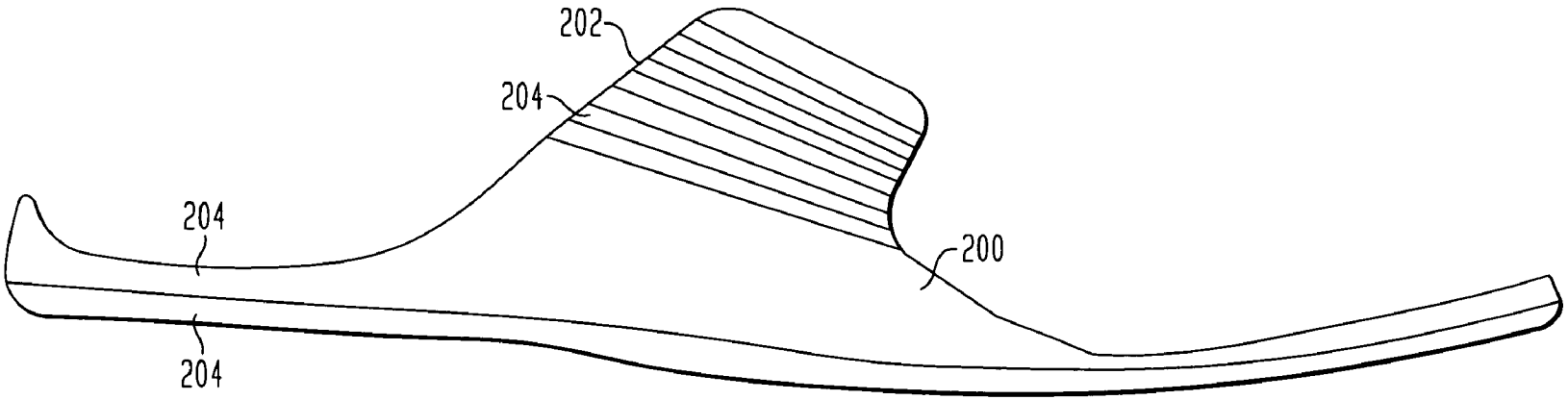
FIG. 6 is a side view of one embodiment of a footbed for an article of footwear having midfoot reinforcement according to the present invention.

FIG. 6 shows an alternate embodiment of a footbed, namely footbed 200, according to the present invention. The footbed 200 may include a top portion 202 that wraps up the side of the wearer's foot, providing midfoot reinforcement for stability and security. It may also extend up and over the instep of the foot for further enhanced protection. The top portion 202 provides additional lateral support to the wearer of the boot. The footbed 200 may also be made up of layers 204 of different materials or a single material of different densities, for added comfort and performance, as discussed above.

In another preferred embodiment, the footbed may be an adjustable footbed, which provides enhanced fit and performance. Examples of such adjustable footbeds may be found in U.S. Provisional Patent Application No. 60/623,475 filed Oct. 29, 2004 and entitled "Shoe Footbed With Interchangeable Cartridges," and in U.S. Provisional Patent Application No. 60/667,970 filed Apr. 4, 2005 and entitled "Shoe Footbed With Interchangeable Cartridges," the entire disclosures of which are hereby incorporated by reference herein.

For instance, FIGS. 2(*a*)-(*c*) in both of the provisional applications illustrate an adjustable, interchangeable cartridge system 200. For instance, FIGS. 2(*a*)-(*c*) in both the 60/623,475 and 60/667,970 provisional applications illustrate an adjustable, interchangeable cartridge system 200. As stated in the interchangeable footbed cartridge system provisional applications, the cartridge system 200 includes a footbed or other shaped area 202 for supporting portions of the foot, as well as a cartridge or resizing member 204. As seen in the exploded and assembled perspective views of FIGS. 2(*b*)-(*c*), the cartridge 204 is insertable into the footbed 202 and is secured in place by releasable fastening means as will be described below. The footbed 202 need not extend the entire length of the foot from the toes to the heel. For instance, the footbed 202 may only be positioned in the toe region of the shoe, or extend from the toes through part or all of the instep region of the sole. The footbed 202 and/or the cartridge 204 may be formed from resilient materials such as EVA or PU foams or other such materials commonly used in shoe midsoles or footbeds. One or both of the footbed 202 and the cartridge 204 may be formed of multiple material layers, regions and/or segments, which may each have a different thickness and/or a different rigidity. For example, the footbed 202 may comprise multiple layers of different rigidity. In this case, a first layer may be, e.g., an EVA layer having a hardness of 20 on the Asker C scale, a second layer may be a PU layer having a hardness of 30 Asker C, and a third may a thermoplastic PU layer having a hardness of 40-50 Asker C. Alternatively, the footbed 202 may have different levels of rigidity in the forefoot, instep and heel regions, respectively. The footbed 202 could also have a first segment about the first metatarsal of a first rigidity and a second segment about the fifth metatarsal of a second rigidity.

Furthermore, as seen in FIGS. 2(*b*) and 2(*c*) of the provisional applications, the fastening means preferably includes one or more tabs, protrusions, plugs or other connection members 212 on the cartridge 204 that engage respective slots or recesses 214 on the footbed 202. The user may line up the connection members 212 with the slots 214 and then push the connection members 212 fully into the slots 214. The connection members 212 preferably extend at least 5.0 mm away from the body of the cartridge 204. Shorter lengths may be appropriate if fastening can be achieved. More preferably, the connection members 212 are on the order of 12.0 mm long or longer, which provides ample connectivity even when the foot is fully flexed during walking or running. Desirably, the connection members 212 are at least 5.0 mm wide for proper fastening, although as shown the connection members 212 are approximately 15 mm wide. Of course, the connection members 212 may be greater or less than these exemplary widths. When the tabs 212 are fully inserted into the slots 214, the cartridge 204 is securely connected to the footbed 202. The connection members 212 may be integrally formed with the rest of the cartridge 204, for example as part of a molding process. Alternatively, the connection members 212 may be fabricated apart from the body of the cartridge 204 and may be attached to the body using, for instance, an adhesive material or glue. In this case, the connection members 212 may be the same or a different material from the cartridge 204, such as EVA, PU or TPU. Moreover, the ends of the connection members 212 may have a "lip" or overhang to assist in a secure and releasable connection to the slots 214.

Figure 19:
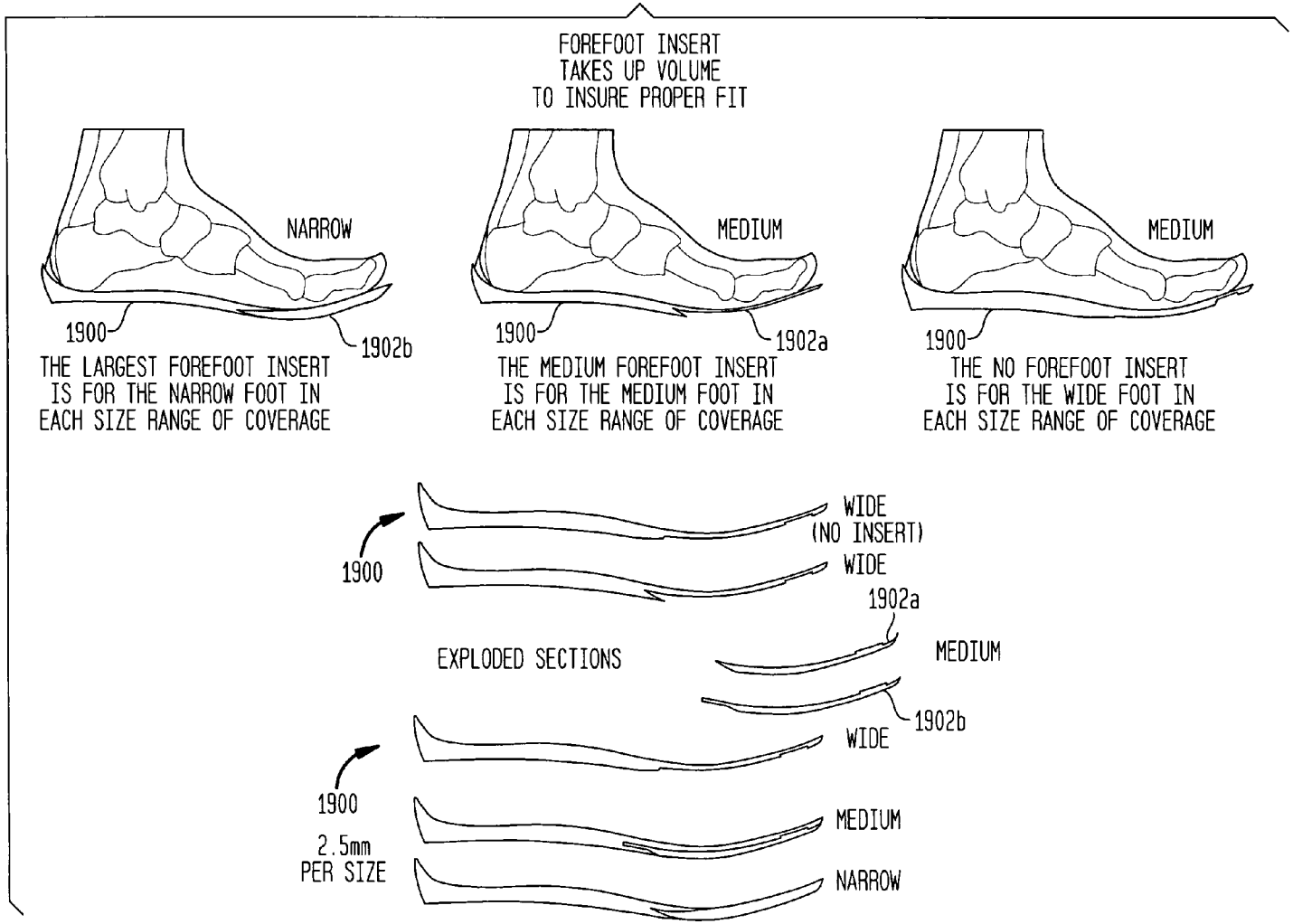
FIG. 19 illustrates an adjustable footbed system in accordance with aspects of the present invention.
Figure 20A:
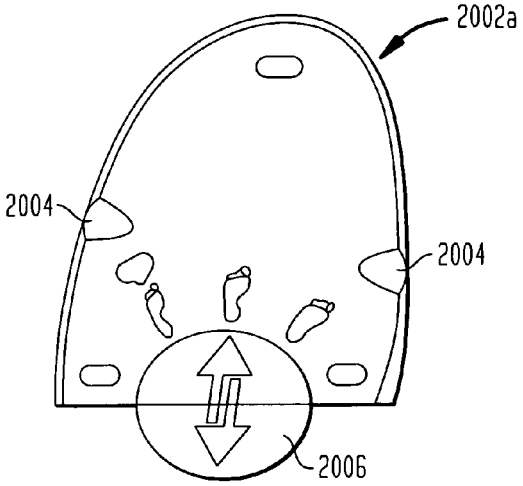
FIGS. 20A-D illustrate another adjustable footbed system in accordance with aspects of the present invention.
Figure 20B:
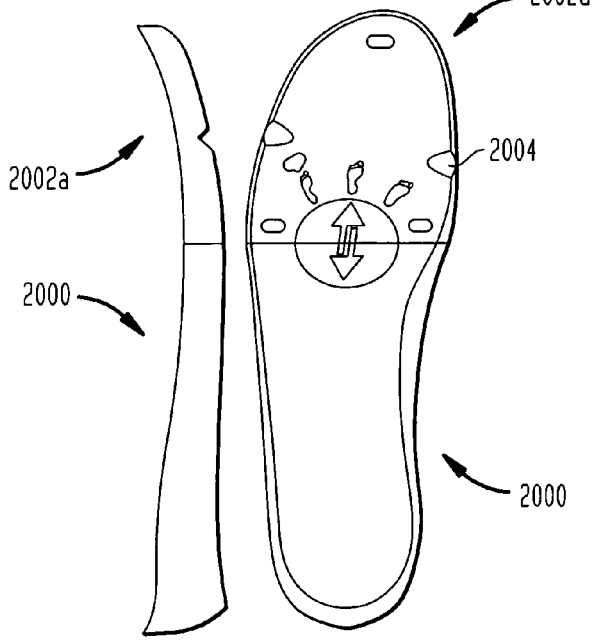
Figure 20C:
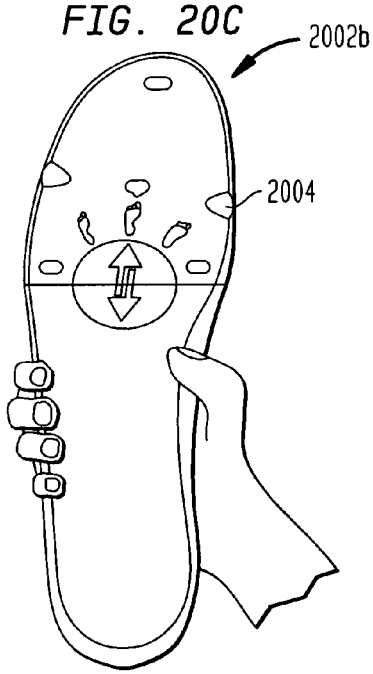
Figure 20D:
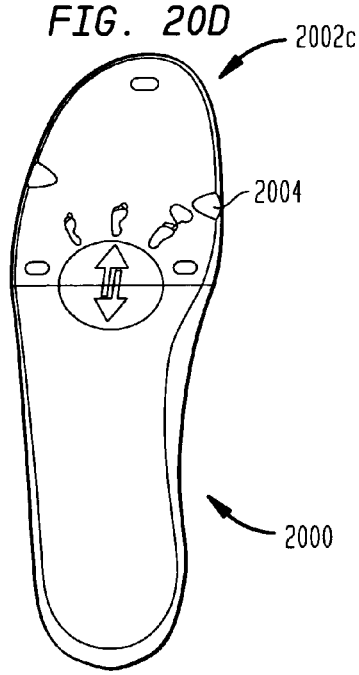

FIG. 19 illustrates how an adjustable, interchangeable footbed cartridge system changes the sizing inside an article of footwear to insure proper fit. In this figure, the footbed cartridge system preferably includes a footbed 1900 as well as cartridges 1902*a* and 1902*b*. As shown, the footbed 1900 may be used without the cartridges 1902*a* or 1902*b* to accommodate a wide size foot. Proper fit for a medium size foot may be achieved by connecting the cartridge 1902*a* to the footbed 1900. Similarly, proper fit for a narrow foot may be achieved by connecting the cartridge 1902*b* to the footbed 1900. Preferably, the cartridge 1902*a* has a thickness on the order of 2.5 mm, for example between 2 and 3 mm, and the cartridge 1902*b* has a thickness on the order of 5 mm, for example between 4 and 6 mm. Of course, it should be understood that any number of cartridges may be employed, either alone or in combination, to achieve proper fit.

FIGS. 20A-20D illustrate an alternative embodiment of a footbed cartridge system in accordance with the present invention. Here, footbed 2000 may connect to any of cartridges 2002*a*, 2002*b* or 2002*c*, which represent narrow, medium and wide inserts, respectively. Each of the cartridges 2002*a-c* may include one or more flex grooves, indentations, score lines, siping or flex areas 2004, for instance on the bottom thereof. A single fastening device such as tab 2006 preferably extends from the cartridge 2002*a, b* or *c* and is securely received by the footbed 2002. See FIG. 20A. As seen in this figure, the tab 2006 may have a geometrical shape such as a partial ellipse, although any other shape may be employed.

Figure 21B:
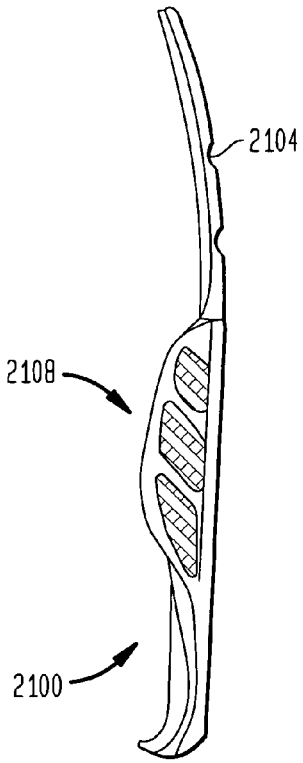
FIGS. 21A-G illustrate an adjustable footbed and support saddle system in accordance with aspects of the present invention.
Figure 21A:
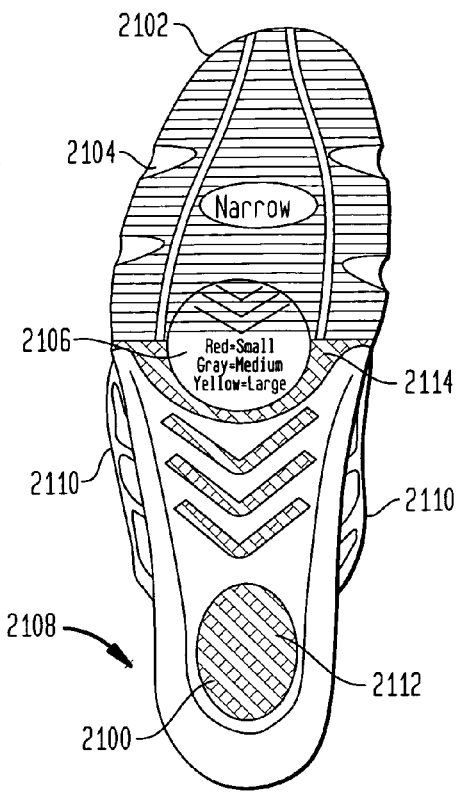
Figure 21C:
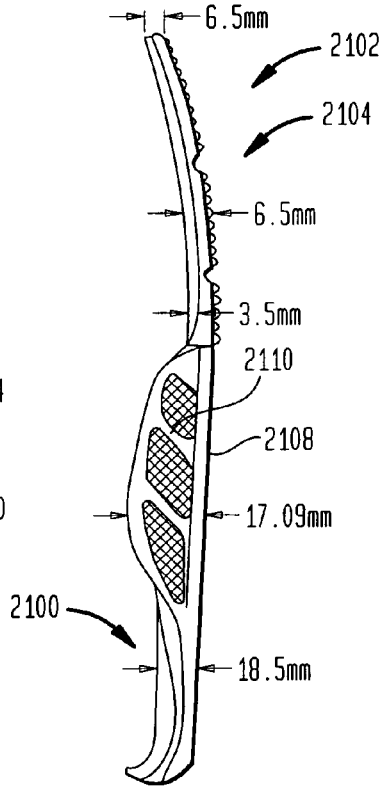

FIGS. 21A-C illustrate an adjustable footbed 2100 and cartridge 2102 in conjunction with a support saddle 2108. The footbed 2100 may be of the same or a different configuration than the footbed 2000. As with footbed 2000, the footbed 2100 may be used alone for a given size foot, or may be used in conjunction with one or more cartridges 2100 of different size, which may be the same or different than the cartridges 2002*a,b* and *c*. As shown, the cartridge 2102 preferably includes more flex grooves, indentations, score lines, siping or flex areas 2104, for instance on the bottom thereof. A single fastening device such as tab 2006 preferably extends from the cartridge 2102 and is securely received by the footbed 2100.

Figure 21D:
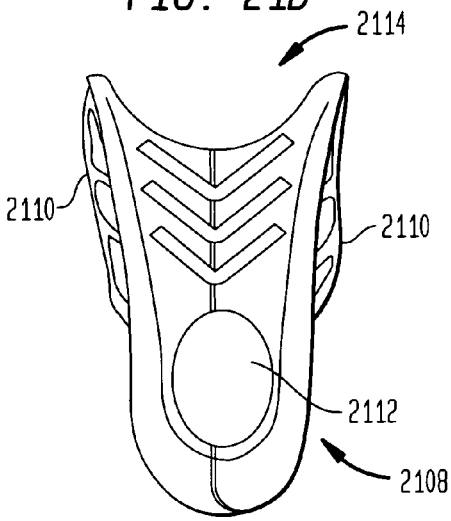

The support saddle 2108 is shown by itself in FIG. 21D. Preferably, the support saddle 2108 allows the cartridge 2102 and/or the footbed 2100 to flex while providing enhanced foot support under extreme loading conditions, which may occur when a soldier carries a heavy pack or is moving heaving equipment on a mission. While the support saddle 2108 desirably comprises a cross-linked polymer, alternative materials, such as thermoplastic polyurethane ("TPU"), may be employed. The support saddle 2108 may include sidewall members 2110, which may be positioned on the medial and/or lateral sides of the support saddle 2108. The sidewall members 2110 enhance the transverse support the support saddle 2108 provides to the footbed 2100. A heel cutout 2112 can permit enhanced cushioning or extra padding in the heel region of the footbed 2100. An instep cutout or contoured region 2114 is preferably provided to enable cartridges 2102 of various sizes and thicknesses to connect to the footbed 2100 without obstruction by the support saddle 2108. Of course, it should be understood that the support saddle 2108 may be used with or without adjustable footbeds or non-adjustable footbeds.

Figure 21G:
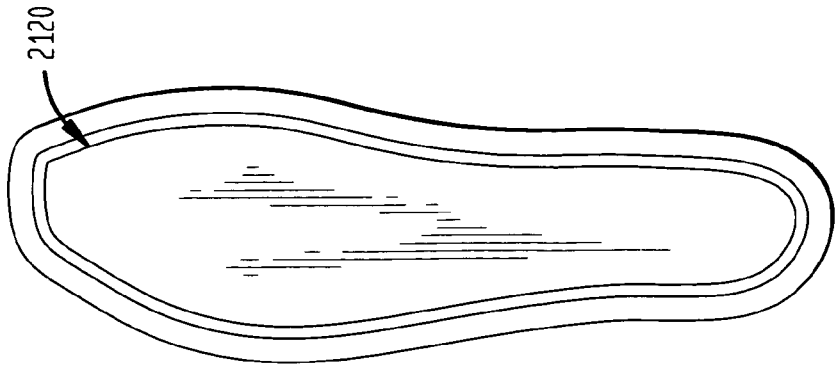
Figure 21F:
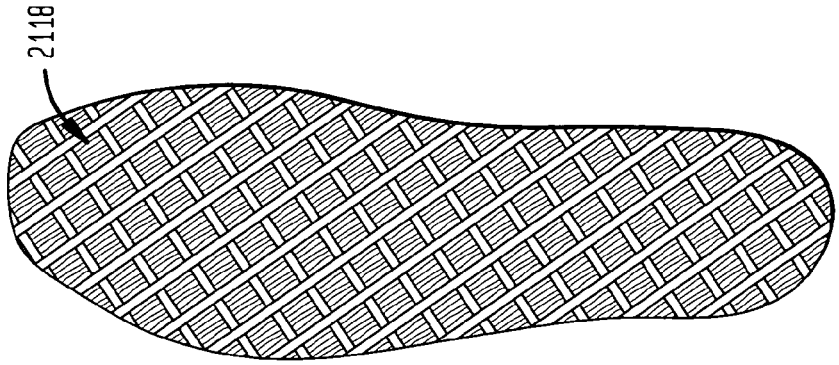
Figure 21E:
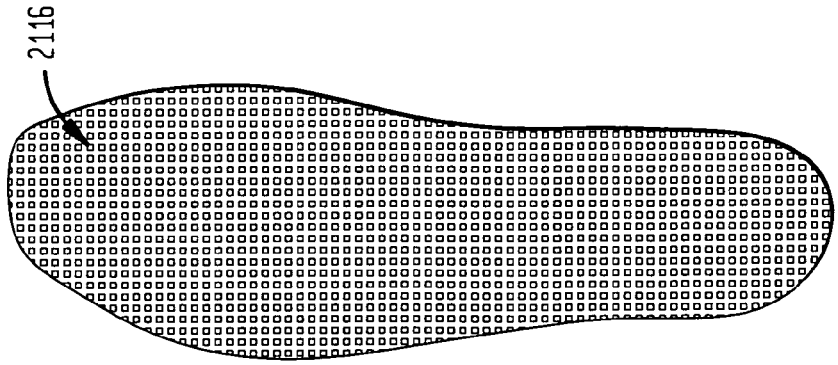

The footbed 2100 and/or the support saddle 2108 may also be used in combination with insole boards, lasting boards and/or insulation boards, which may be positioned below the footbed 2100 and/or the support saddle 2108 within the shoe, boot or other article of footwear. Treatments such as material layers or compounds may be applied on or to the footbed 2100. FIG. 21E illustrates a top view of a footbed showing treatment 2116 that is preferably puncture proof. The footbed treatment 2116 may comprise, for example, aramid blend fibers such as KEVLAR. While the footbed 2116 may be used in any number of environments and conditions, it is particularly suited for desert and urban warfare. FIG. 21F illustrates a top view of footbed 2118, with a treatment which preferably includes insulative non-woven fibers like THINSULATE brand fibers from 3M Company. While the footbed 2118 may be used in any number of environments and conditions, it is particularly suited for mountain warfare and cold environments. FIG. 21G illustrates a top view of a footbed 2120, with a treatment which preferably includes a heat reflective coating or layer like that of DUAL MIRROR® by Gentex, which is an aluminum and aramid laminate used for extreme flame and heat protection. While the footbed 2120 may be used in any number of environments and conditions, it is particularly suited for desert warfare and hot environments. Alternatively, the heat reflective coating or layer may be applied in combination with other treatments such as that described for FIG. 2116 or used conversely to reflect heat produced by the wearer's foot to enhance warmth within the shoe in extreme cold conditions.

Figure 17B:
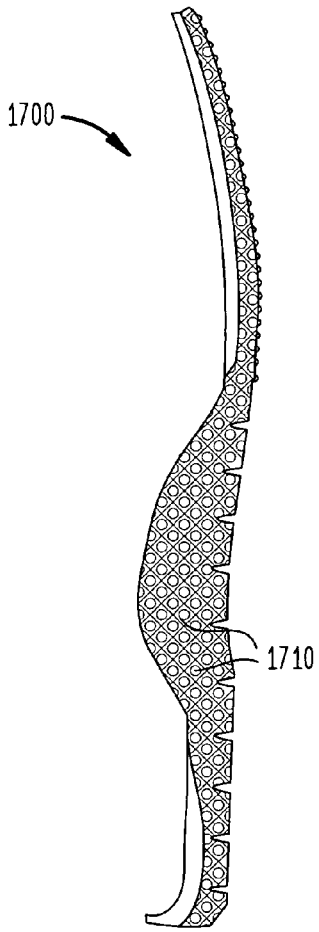
FIGS. 17A-17F are views of an alternative footbed configuration according to the present invention.
Figure 17A:
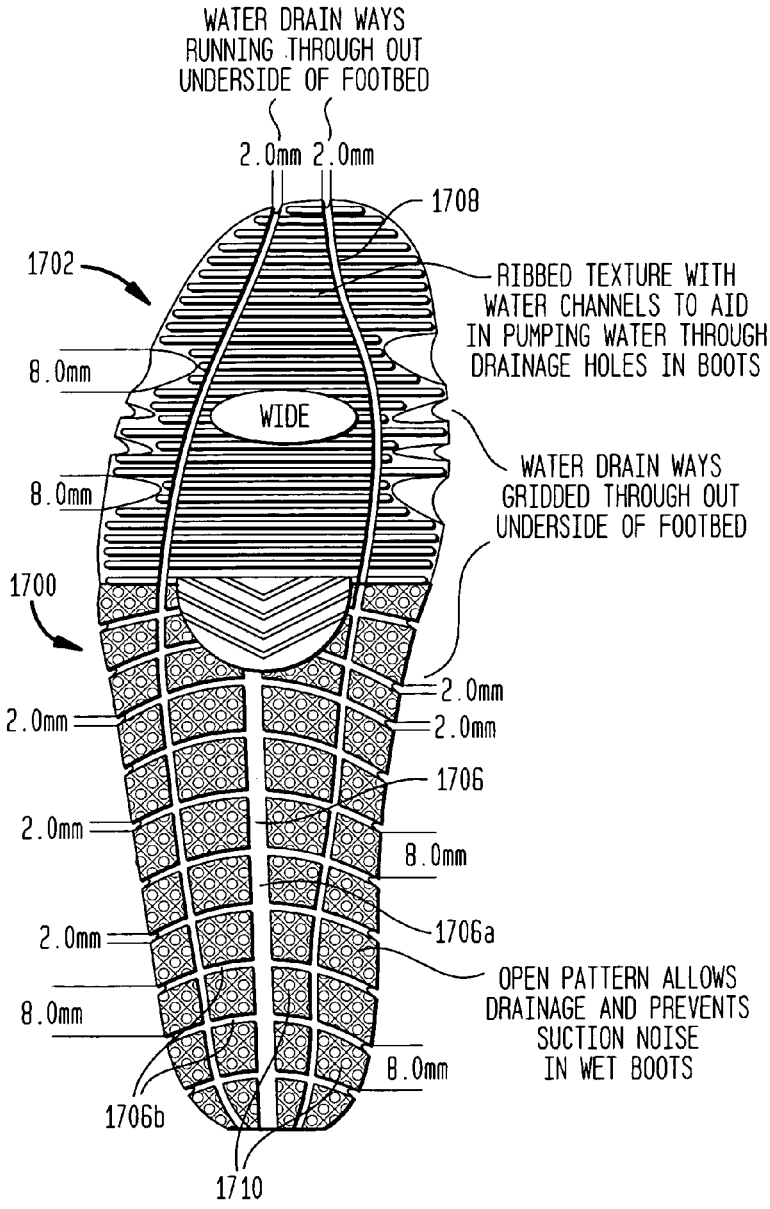
Figure 17C:
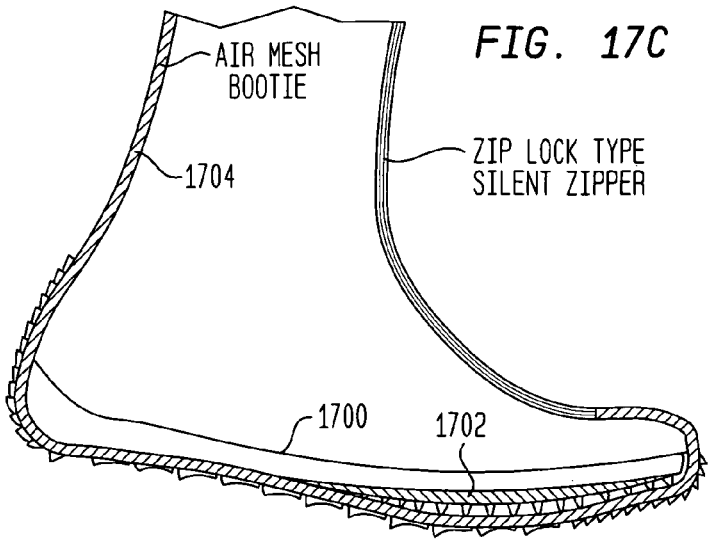

FIGS. 17A and 17B depict bottom and side views, respectively, of an adjustable footbed 1700 in accordance with the present invention. As with the adjustable footbeds discussed above, the footbed 1700 may be used alone or in combination with one or more cartridges 1702 that are used to vary the volume within the shoe, boot or other article of footwear. The footbed 1700 may also be used in combination with the support saddle 2108 and other components discussed herein. FIG. 17C illustrates the footbed 1700 and one cartridge 1702 positioned within a bootie 1704, such as an air mesh bootie.

Returning to FIG. 17A, it can be seen that the footbed 1700 preferably includes one or more channels or pathways 1706 that are adapted to channel water away from the footbed 1700 and out of the inside of the boot. The channels 1706 may include longitudinal channels 1706*a* that run substantially or generally lengthwise along the footbed 1700 and/or transverse channels 1706*b* that run substantially or generally from the medial side to the lateral side of the footbed 1700. Alternatively, the channels 1706 may run in any direction or path along the footbed 1700. The cartridge 1702 may also include one or more channels 1708 therein. Preferably, at least one of the channels 1708 aligns with at least one of the channels 1706. The channels 1706 and 1708 are adapted to break the capillary effect and drive water away from the boot.

Figure 17F:
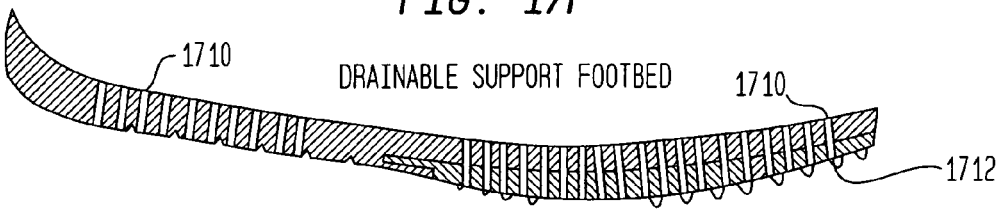
Figure 17D:
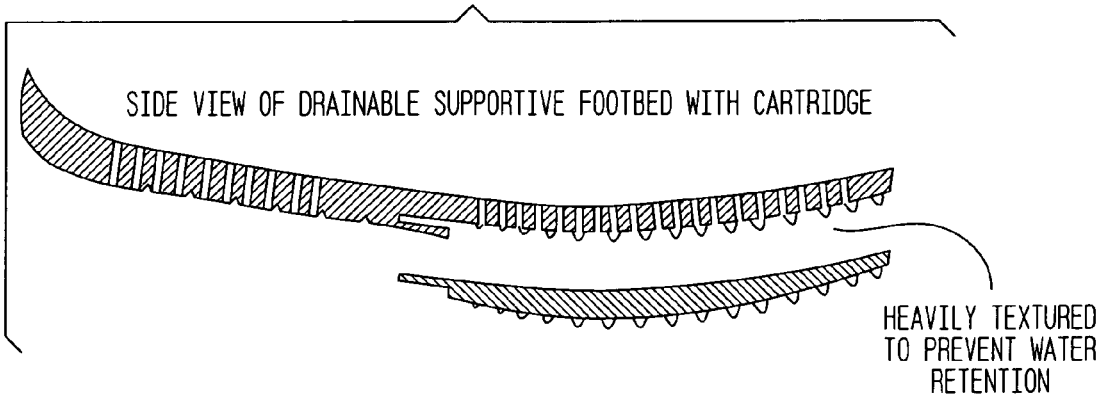
Figure 17E:
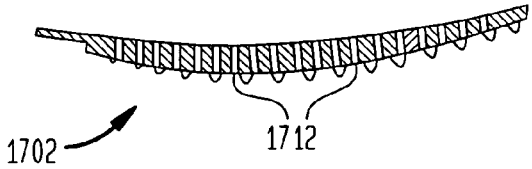

As best seen in the side view of FIG. 17D, the footbed 1700 preferably also includes, either alone or in combination with the channels 1706, perforations or vertical pathways 1710 running from the top or foot contacting surface of the footbed 1700 to the bottom thereof. The pathways 1710 promote water drainage away from the top surface of the footbed 1700. The sectional view of FIG. 17E shows that the cartridge 1702 preferably also includes perforations or vertical pathways 1712 therein. As with the footbed pathways 1710, the cartridge pathways 1712 promote water drainage. Most preferably, the cartridge pathways 1712 align with the footbed pathways 1710 when the cartridge 1702 is connected to the footbed 1700, as seen in the sectional view of FIG. 17F.

Figure 3:
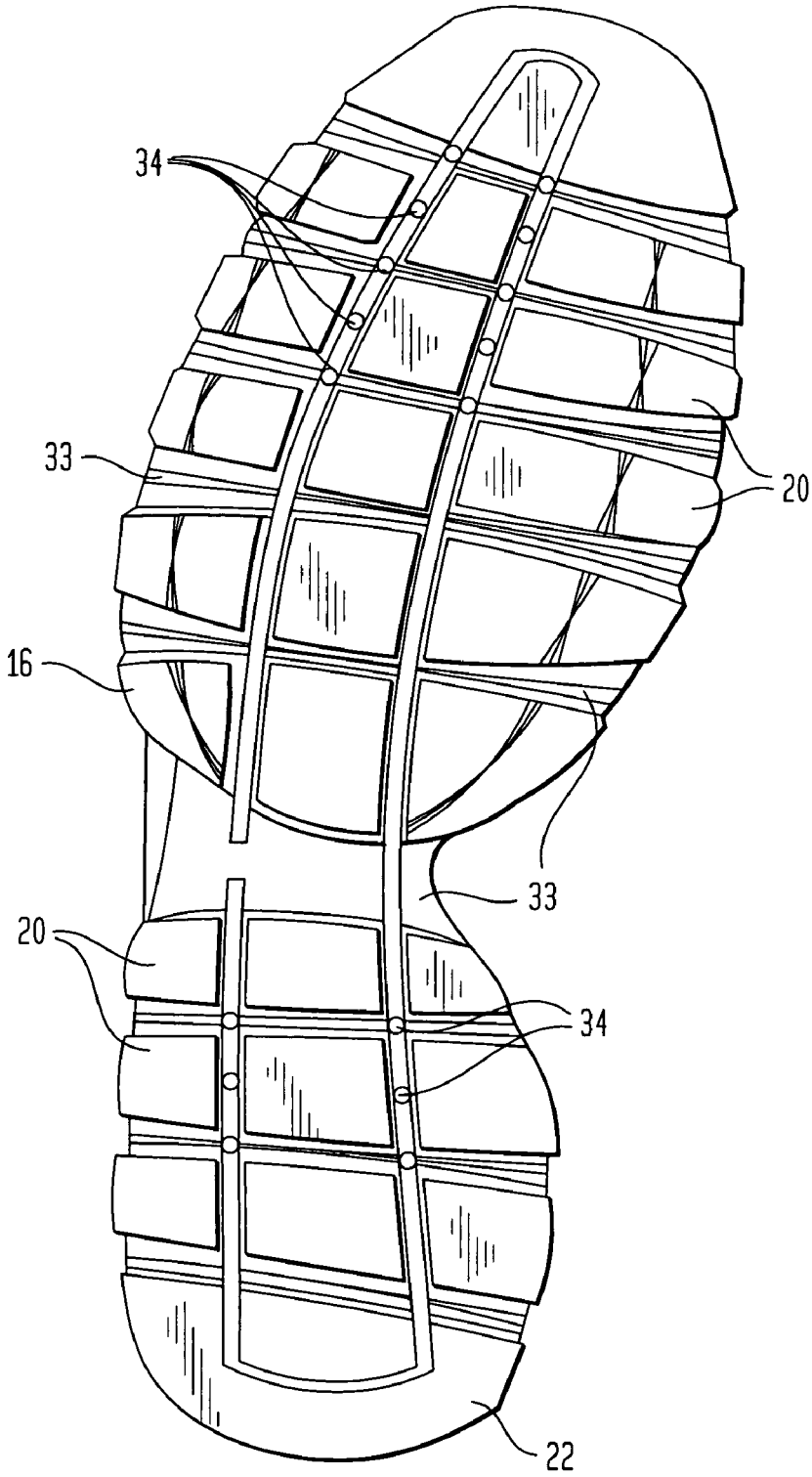
FIG. 3 is a bottom view of an outsole according to a preferred embodiment of the invention.
Figure 5:
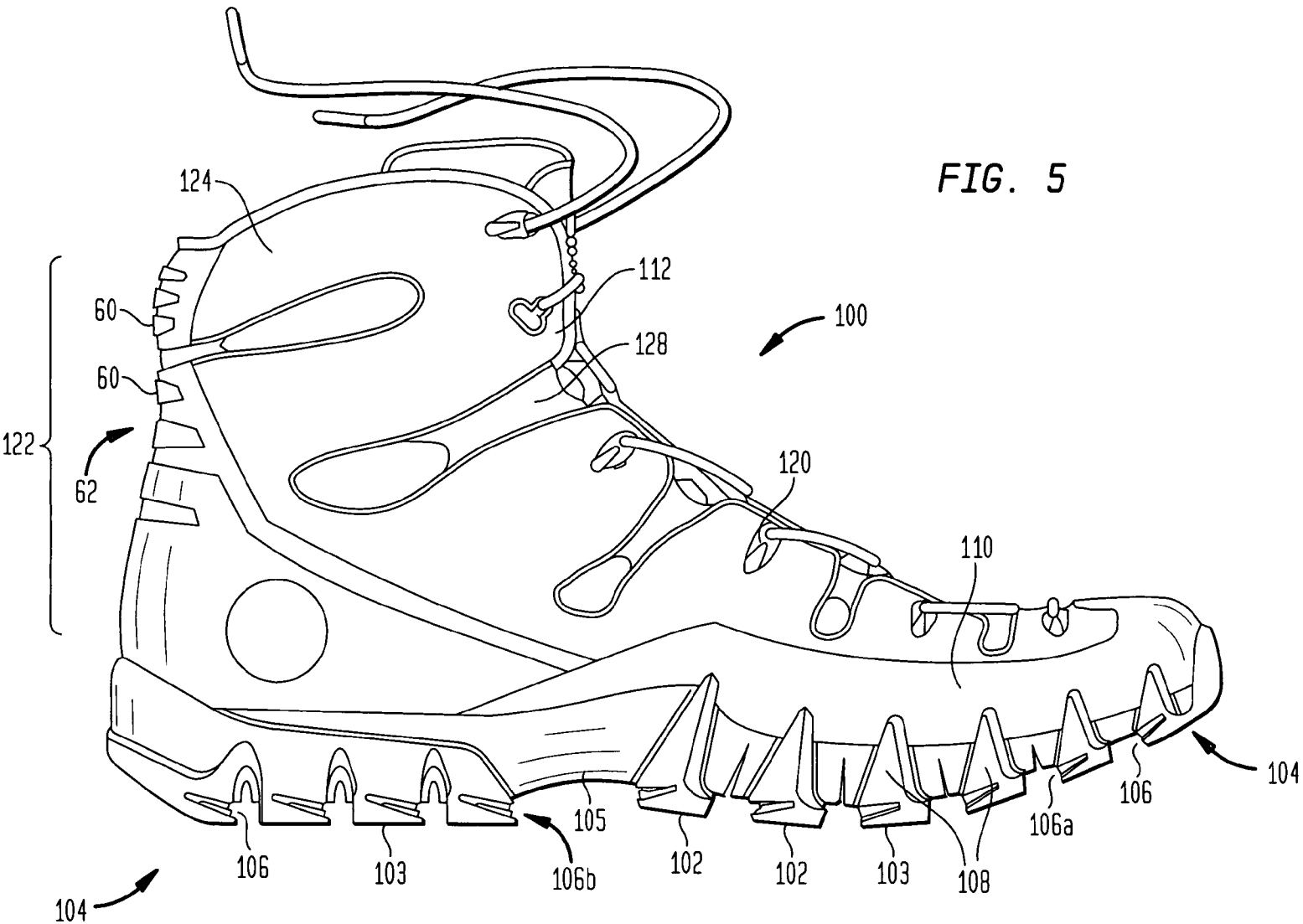
FIG. 5 is a side view of an alternate embodiment of an article of footwear according to the present invention.

FIG. 3 shows a bottom view of a preferred embodiment of an outsole 16 that may be used, for example, with the boot 1 or with another article of footwear, such as shown in FIG. 5. The outsole 16 at least partly overlies a midsole 33, which may comprise an EVA such as compressed EVA. A plurality of drainage holes 34 are preferably positioned so as to allow water to drain out the bottom of an article of footwear, for example through the midsole 33 and/or the outsole 16. The drainage holes may be one-way drainage holes such as the drainage holes 134 discussed above that prevent water from entering the article of footwear. The holes 34 are preferably positioned between the lugs 20 to allow space between the outsole 16 and the ground for the drainage of water. Desirably, the holes 34 may be aligned with the drainage holes of the footbed 30 discussed above. Alternatively, the holes 34 may be aligned with the channels 1706 and 1708 and/or the pathways 1710 and 1712 of the footbed 1700 and cartridge 1702 discussed above. The drainage holes 34 may also allow for airflow into and out of the article of footwear.

FIG. 5 shows an alternate embodiment of an article of footwear 100 according to the present invention. The article of footwear 100 desirably comprises a boot, although other types and styles of footwear may be employed. The boot 100 preferably has a plurality of lugs 102 on the ground contacting portion of outsole 104, which connects to midsole 105. As shown in this figure, the lugs 102 in the heel region of the outsole 104 are part of a singular structure, while the lugs 102 in the forefoot region of the outsole may comprise individual or separate segments attached to the midsole 105. The lugs 102 preferably contain ridges or recesses 106 on one or more side surfaces for increased cushioning and/or traction. For example, some of the lugs 102 may have ridges or recesses 106*a* on the side surface of the lugs 102 facing the heel portion of the boot 100. Other ones of the lugs 102 may have ridges or recesses 106*b* on the side surface of the lugs 102 facing the toe portion of the boot 100. The ridges/recesses 106 are preferably adjacent to, meaning less than about 3 mm, such as 1 to 2 mm away from, the ground contacting surface 103 of the lugs 102. Each ridge/recess 106 is preferably on the order of 2 mm or less in height. There may be one or more ridges/recesses 106 on each lug 102. Preferably, the ridges/recesses 106 are formed during the molding or other fabrication process used to obtain the outsole 104. Optionally, the ridges/recesses 106 comprise or are coated with a material having a higher coefficient of friction than the ground contacting surface 103 and/or other portions of the lugs 102. The ridges/recesses 106 enhance the traction of the boot 100 in certain situations, such as if the user is standing in snow during heavy wind. The ridges/recesses 106 also provide additional flexibility to the lugs 102, which is useful for traction and stability on uneven surface terrain. In one example, the ridges/recesses 106 are only positioned on the rear of the lugs 102 that are on the front or metatarsal portion of the boot 100, that is from the arch forward to the toe region, and are only positioned on the front of the lugs 102 that are on the rear or heel portion of the boot 100, that is from the arch to the heel region. The lugs 102 on at least the front portion of the boot 100 preferably extend up one or both sides of the boot 100, for example past the midsole 105 to rand 110, forming side portions 108 of the lugs 102. These side portions 108 provide additional traction to the wearer of the boot in difficult terrain or position of surface contact or when traction is needed on the side of the boot 100. The lugs 102 with side portions 108 are "wraparound lugs" as they wrap up the sides of the boot 100.

The upper 122 of the boot 100 depicted in FIG. 5 may be made up of regions, such as a fabric region 124 and an elasticized region 128, which may be part of a bootie. The bootie may be, e.g., neoprene or other stretchable material. The fabric region 124 is preferably made of a breathable fabric which may be waterproof, puncture proof, and flame retardant as discussed above. The fabric region 124 preferably comprises a material like SUPERFABRIC brand materials from HDM Inc. These materials may have properties such as cut resistance, abrasion resistance, puncture resistance, and/or flame resistance, as well as flexibility and enhanced grip. The elasticized regions 128 are preferably made of a stretchable material in order to provide the boot 100 with greater flexibility in key regions for enhanced foot security and comfort.

The boot 100 preferably also includes a rand 110 which may be made of, for example, brushed rubber or other material with a high coefficient of friction, for example a coefficient of friction equal to or greater than that of the lug bottoms 103. The rand 110 provides greater traction and durability for the wearer.

Figure 5A:
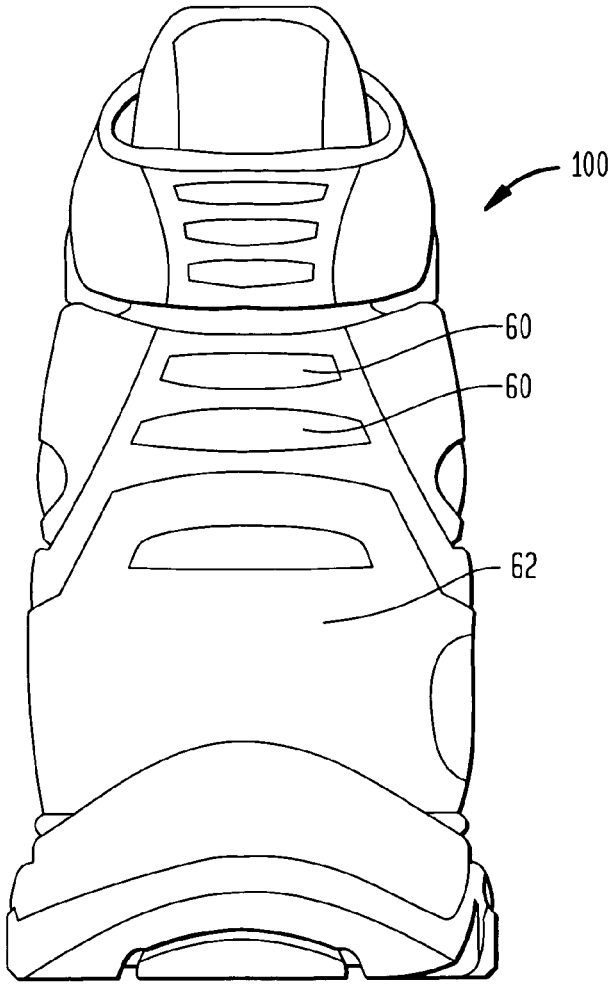
FIG. 5A is a rear view of the article of footwear depicted in FIG. 5.

FIG. 5A shows the rear of the boot 100 depicted in FIG. 5. The boot 100 preferably has a heel protector or rand 62, that may also be made of brushed rubber or other material with a high coefficient of friction, extending up the rear of the boot, preferably past the midpoint of the height of the boot 100. The heel protector 62 may have ridges 60 which allow the user to easily remove the boot. The ridges 62 may also comprise rubber, which enable enhanced traction on all types of surfaces and conditions.

Referring back to FIG. 5, various portions of the boot 100 may be made of a high traction rubber substance or other tacky material. Such high traction rubber substances are desirably formulations of rubber with a higher coefficient of friction or lower hardness as measured in Shore A than standard rubber, as explained above. The high coefficient of friction material enhances traction. This type of rubber is commonly used in performance footwear, especially on climbing shoes and the like. The high traction rubber or other tacky material may coat the lugs 102, the rubber portion 110, the forward rand 110, the heel protector 62 and/or other portions of the boot 100.

Figure 5B:
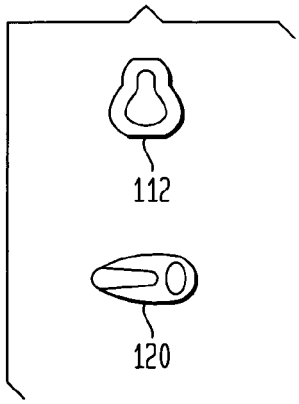
FIG. 5B illustrates eyelets that may be used in accordance with aspects of the invention.

The boot 100 of FIG. 5 may also include at least one locking eyelet 112, also shown in FIG. 5B. The locking eyelet 112 is generally T-shaped and locks the laces in place when the laces are pulled into the narrow area of the eyelet 112. The locking eyelet 112 may be, e.g., hard plastic, metal, PU, etc. Alternatively, the boot 100 may include rounded eyelets 120, also shown in FIG. 5B, which are preferably made of plastic. The rounded eyelets 120 are preferably molded or otherwise fastened directly to the fabric portions 124 of the boot 100.

Bottom views of various different embodiments of outsoles to be used with an article of footwear according to this invention are depicted in FIGS. 8A-D. The outsoles 800 preferably have lugs 802 in different configurations adapted to provide traction based on the type of terrain the wearer is expecting to traverse. For example, the lugs 802 may have different ridges, shapes, profiles, and may articulate in some configurations.

Figure 22A:
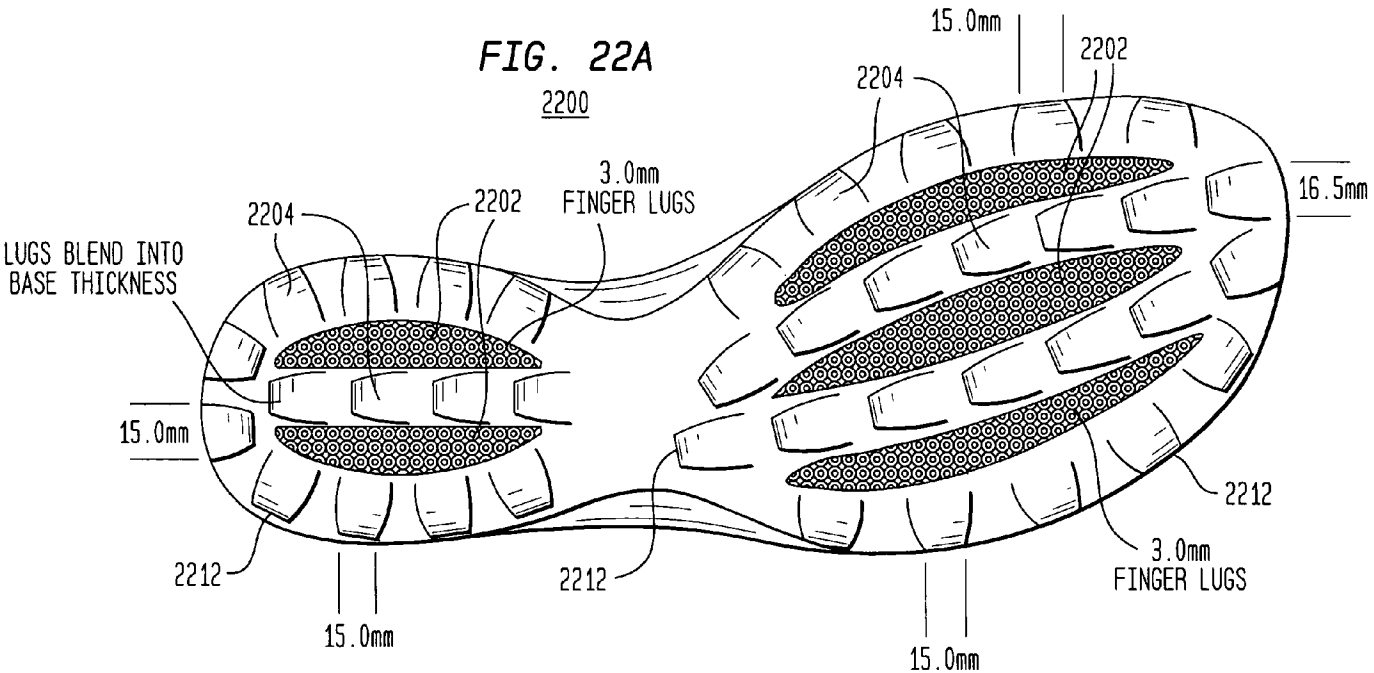
FIGS. 22A-C illustrate an outsole configuration in accordance with aspects of the present invention.
Figure 22C:
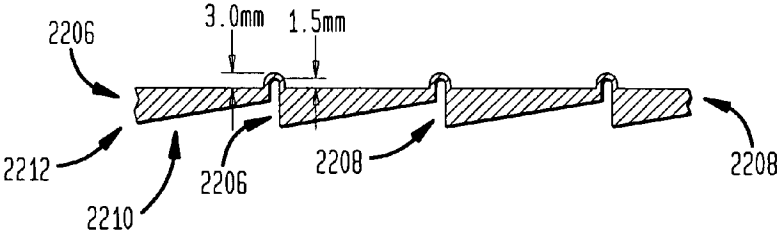
Figure 22B:
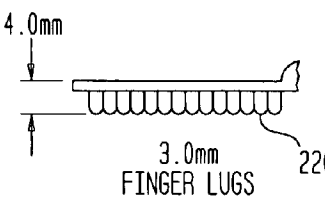

Another outsole variation is illustrated in FIGS. 22A-C. FIG. 22A shows a bottom view of outsole 2200 having two kinds of lugs, namely finger lugs 2202 and angled lugs 2204. As shown, the finger lugs 2202 are positioned along inner sections of the outsole 2200 in the heel and forefoot sections thereof. Some of the angled lugs 2204 are positioned along the perimeter of the outsole 2200, and other angled lugs 2204 are also positioned along the inner sections of the outsole 2200. In the figure, the heel section of the outsole includes two regions of finger lugs 2202 on either side of a central set of the angled lugs 2204, and the forefoot section forward of the arch includes three regions of finger lugs 2202 separated by two sets of the angled lugs 2204. Of course, other lug configurations and arrangements are possible, as any number of finger lug regions may be separated by different arrangements of angled lugs 2204.

FIG. 22B illustrates a sectional view of the finger lugs 2202 as taken along the A-A line of FIG. 22A. Individual finger lugs 2202 are preferably cylindrical, having a circular bottom as seen in FIG. 22A. The finger lugs 2202 are preferably flexible, and provide enhanced traction, surface contact and gripping.

FIG. 22C illustrates a sectional view of the angled lugs 2204 as taken along the B-B line of FIG. 22A. As shown, each angled lug 2204 desirably includes a first sidewall 2206 of a first length, a second sidewall 2208 of a second length shorter than the first length, and an angled surface 2210 running from the first sidewall 2206 to the second sidewall 2208. The first sidewall 2206 adjoins the angled surface 2210 at region or point 2212. The angled surface 2210 improves the traction of the outsole 2200 on non-planar surfaces, and the angled lugs 2204 can also act as micro-shock absorbers. For angled lugs 2204 disposed around the perimeter of the outsole 2200, the regions 2212 are preferably positioned along the outermost edges or sections of the outsole 2200. For angled lugs 2204 disposed along interior sections of the outsole 2200, the regions 2212 may be on the posterior or rear sections of the lugs 2204, or may be on the anterior or front sections thereof. More preferably, the regions 2212 are positioned along the posterior sections of the lugs 2204 disposed along interior sections of the forefoot, and the regions 2212 are positioned along the anterior sections of the lugs 2204 disposed along interior sections of the heel.

Figures 23A, 23B, 23C:
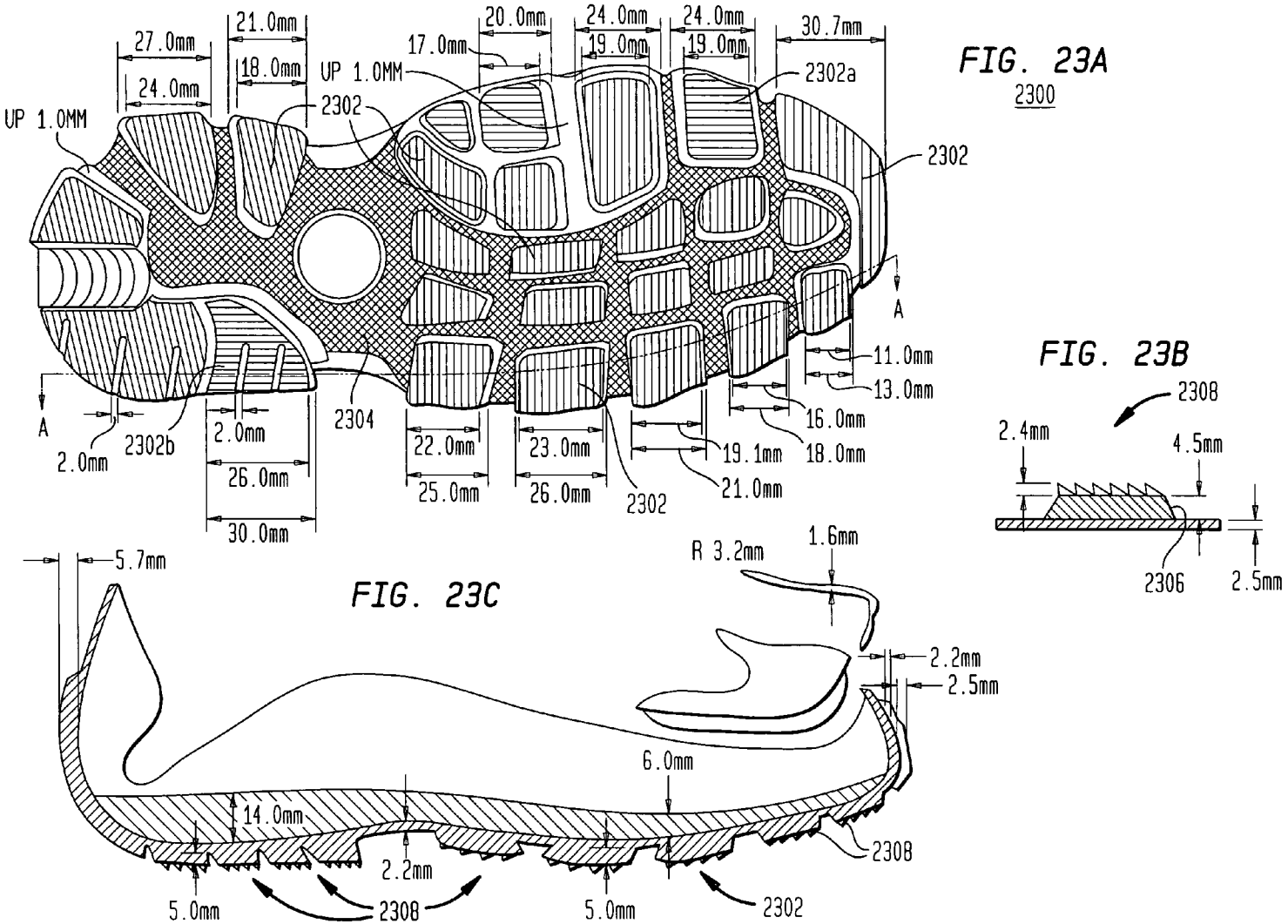
FIGS. 23A-E illustrate another outsole configuration in accordance with aspects of the present invention.

FIG. 23A illustrates another outsole configuration 2300. As shown in the figure, the outsole 2300 preferably includes lugs 2302 disposed on section 2304, which may be part of the outsole 2300, part of an exposed midsole, or both. A side view of one of the lugs 2302 is show in FIG. 23B. Here, it can be seen that bottom surface 2306 of the lug 2302 includes projections or ridges 2308. As shown, the contact points or tips of the ridges 2308 are desirably angled to provide enhanced gripping power and traction for the outsole 2300. As seen in the cutaway view of FIG. 23C along the A-A line of FIG. 23A, the ridges 2308 in the forefoot section of the outsole 2300 forward of the arch are preferably angled toward the posterior or heel region of the outsole 2300. Conversely, the ridges 2309 in the heel section of the outsole 2300 are preferably angled toward the anterior or toe region of the outsole 2300. Of course, it should be understood that the ridges 2308 may be positioned in different angles or configurations, such as transversely facing toward the medial or lateral side of the outsole, as seen in FIG. 23*a* with lug 2302*a* or lug 2302*b*. Any number of ridges 2308 may be disposed on the lug 2302, including a single ridge 2308, at any angle or orientation.

Figure 23D:
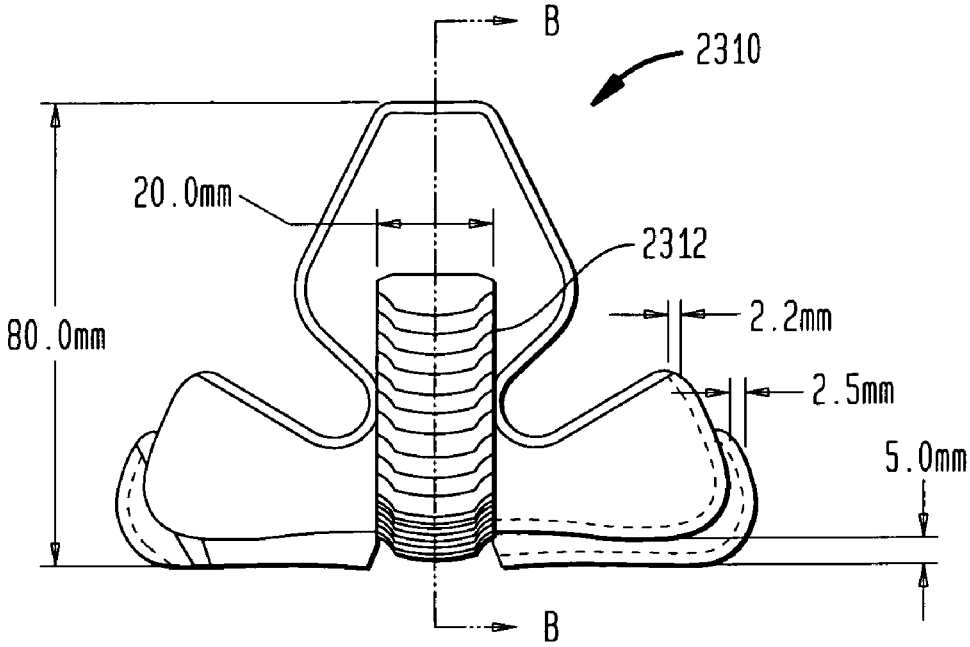
Figure 23E:
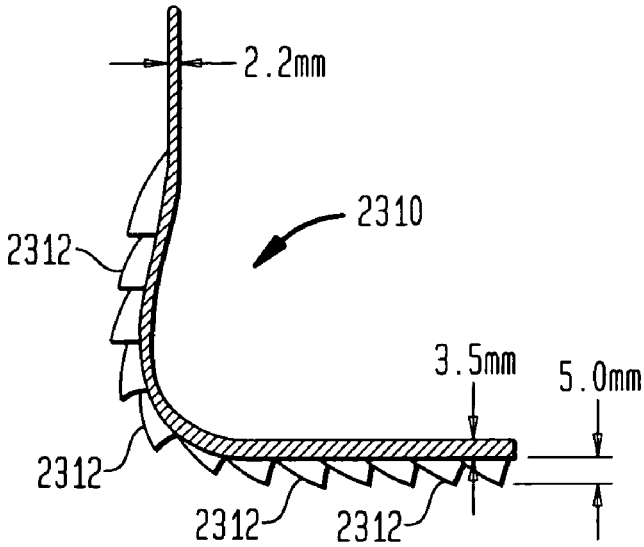

FIG. 23D illustrates a back or rear section 2310 of the outsole 2300 that may wrap up and over a portion of the upper or the midsole of a boot or other article of footwear. As seen in the sectional view of FIG. 23E taken along the B-B line of FIG. 23D, the rear section 2310 preferably includes a plurality of projections or ridges 2312, which may be similar to the ridges 2308. As shown in the figure, the ridges 2312 are preferably aligned in a column, and wrap around bottom of the outsole 2300 as well. The ridges 2312 provide enhanced traction when the solder or other wearer is climbing a building, scaling a wall, rappelling, or descending steep and or slippery terrain, etc. While only one column of ridges 2312 is shown, multiple columns and other arrangements may be provided.

Figure 9:
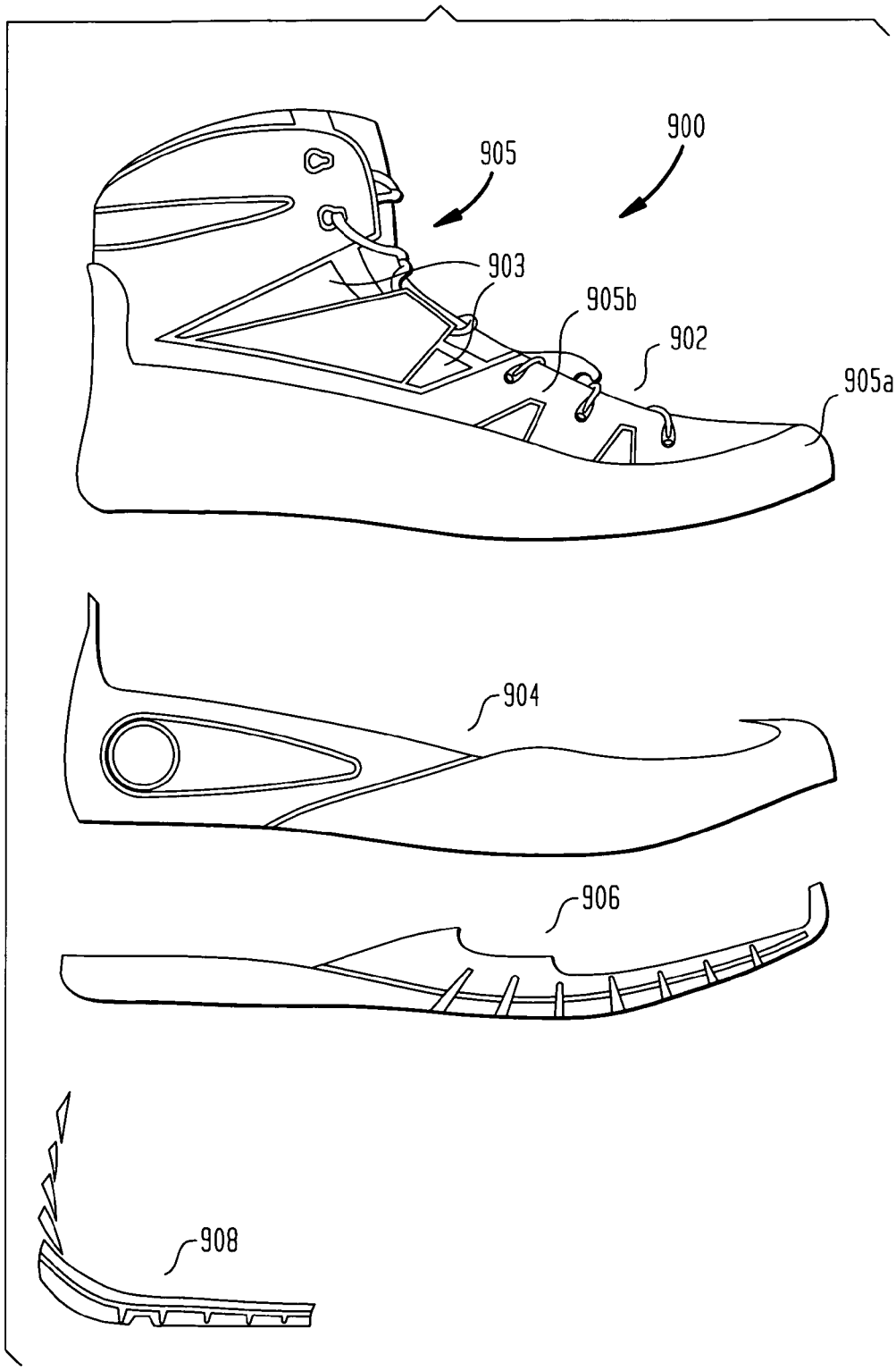
FIG. 9 is an exploded view of an alternate embodiment of an article of footwear according to the present invention.

FIG. 9 illustrates an article of footwear 900 according to an alternate embodiment of the present invention. The exploded view of FIG. 9 shows an upper section 902 according to this embodiment before it is attached to a protective shell or rand 904. In particular, the upper section 902 includes a bootie 903 covered by one or more fabrics 905, which may be SUPERFABRIC® brand material as discussed above. For example, the fabric 905 may comprise a first fabric 905*a* that may be substantially or completely covered by the rand 904, and a second fabric 905*b* above it. FIG. 9 also shows a midsole 906 and an outsole or partial outsole 908, both of which may form a unitary structure. The outsole 908 comes up the back of the article of footwear 900 for added traction. The protective shell 904 of this embodiment preferably comprises at least an outer layer of brushed rubber or other tacky material and provides enhanced protection to the foot of the wearer. For example, the protective shell 904 may be positioned over a section of the upper 902 that is generally at and below ankle height. Preferably, the protective shell 904 forward of the instep is positioned below the lacing eyelets. The protective shell 904 may wrap circumferentially around the article of footwear 900. In one preferred embodiment, the protective shell 904 has a coarse, rough or tacky texture and extends from the outsole 906 up one-third or one-fourth of the boot 900. The heel protector 908 of this embodiment preferably attaches to the rear of the boot 900 and provides protection of the wearer's heel against impact from the rear. The heel protector 908 also provides extra traction to the wearer in certain situations.

Figure 10:
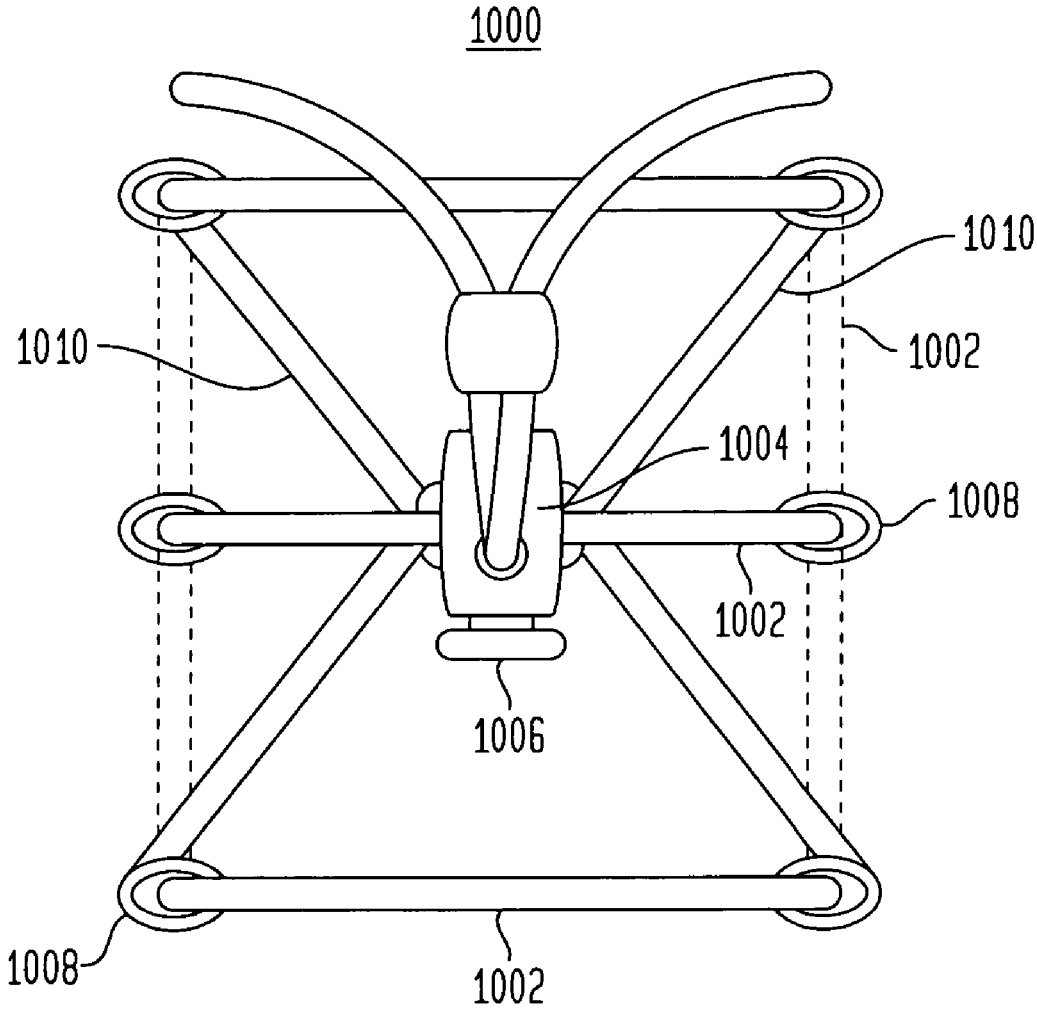
FIG. 10 depicts an embodiment of a lace-retention device according to one embodiment of the present invention.

FIG. 10 depicts a cinching device system 1000 including one or more laces 1002 and a lace locking device 1004. The lace locking device 1004 is desirably attached to the lace 1002 of the footwear to prevent the lace 1002 from becoming loose and slipping during use. The lace-locking device 1004 preferably includes a button 1006 which will release the lace 1002 when depressed and lock the lace 1002 when released. Eyelets 1008 are positioned along the upper, bootie or elsewhere. As shown, the dashed lines illustrate the lace 1002 inside the upper or elsewhere in an article of footwear. Support members such as cables 1010 may be employed to secure, position and/or support the lace-locking mechanism 1004 on the article of footwear. The lace locking device 1004 is useful in situations where the wearer does not have time to stop and tie his or her laces repeatedly, such as combat situations, and provides "on the fly" adjustment. The lace-locking device 1004 is preferably located along the tongue or anterior portion of the article of footwear, more preferably along the metatarsal region of the lace 1002, desirably such as below ankle height. In this case, the soldier or other user can quickly adjust the lace 1002 in the metatarsal region without having to re-lace the entire boot. The lace 1002 may be adjustably engaged with the lace-locking device 1004 using a plunger or other mechanism which presses the lace against the side of the lace-locking device 1004.

Figure 11:
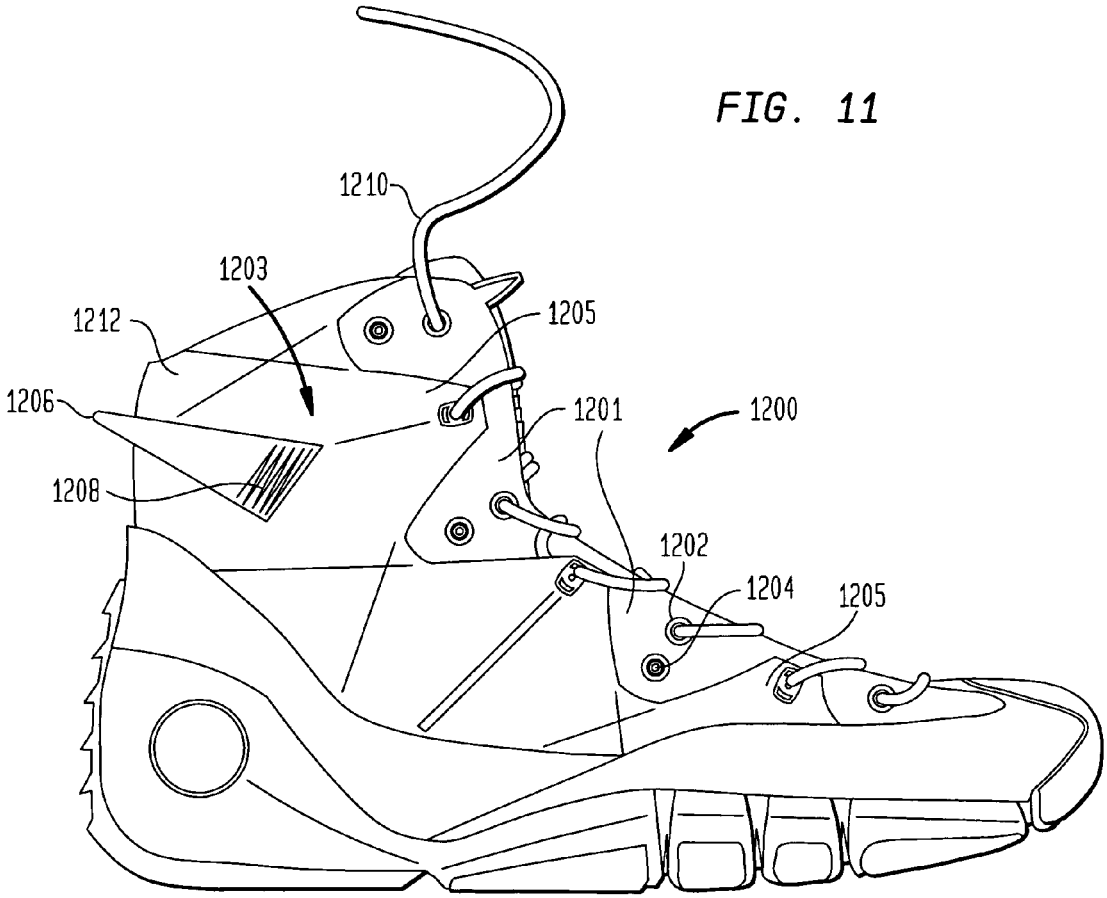
FIG. 11 is a side view of an alternate embodiment of an article of footwear according to the present invention.

FIG. 11 shows an alternate embodiment of an article of footwear 1200 according to the present invention. The article of footwear 1200 preferably comprises a boot configuration, although other footwear styles and fashions may be selected. The boot 1200 includes a bootie 1201 that may be substantially covered by upper 1203. As shown, projections or fingers 1205 of the upper 1203 may further extend over the bootie 1201 than other sections of the upper 1203. The boot 1200 preferably has a first row of eyelets 1202 and a second row of eyelets 1204 located adjacent the first row and further into the upper 1212 and away from the tongue than the first row. As shown, some of the eyelets along the first row 1202 are positioned on the fingers 1205 of the upper 1203 and other eyelets along the first row 1202 are positioned only on the bootie 1201, while the second row of eyelets 1204 are shown only positioned on the bootie 1201. Alternatively, some or all of the eyelets along the first row 1202 may be positioned on the fingers 1205 of the upper 1203, on the bootie 1201 or both, and the second row of eyelets 1204 may be positioned only on the bootie 1201, only on the fingers 1205, or both. Of course, eyelets may be positioned elsewhere on the upper 1203 aside from the fingers 1205. The lace(s) 1210 of the boot 1200 may be laced through the additional row of eyelets 1204 in order to more securely hold the boot 1200 to the foot of the wearer. The boot 1200 may also utilize a zipper closure in place of or in combination with the lacing, such as described in the aforementioned patent application entitled "Footwear for Hostile Environments." In this case, the zipper closure is preferably a quiet or silent zipper. Unlike conventional zipper configurations with "teeth," quiet or silent zippers have a closure mechanism the same or similar to that found on ZIPLOC® type food storage bags. Boot 1200 preferably also includes a pull tab 1206. The pull tab 1206 is preferably used to easily pull the boot 1200 on to the foot of the wearer. The pull tab 1206 may also be useful in removing the boot 1200 or storing the boot 1200 when not in use. The pull tab 1206 is preferably made of nylon webbing which is crimped to create stiffness. The pull tab 1206 is preferably attached to the upper 1203 with a series of stitching 1208, preferably along heel 1212 of the upper 1203.

Figure 12:
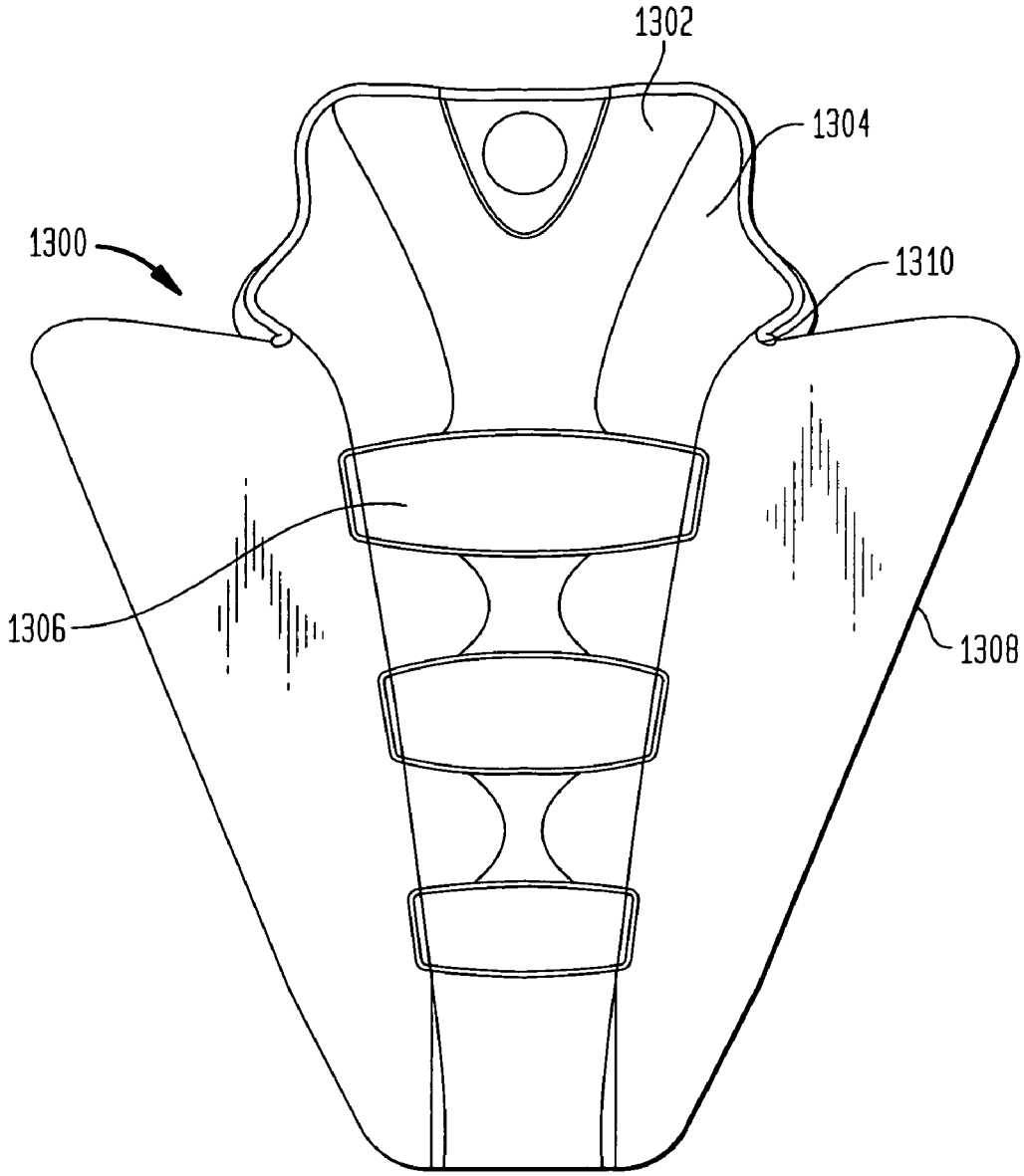
FIG. 12 is an embodiment of a gusset to be used in one embodiment of an article of footwear according to the present invention.
Figure 13:
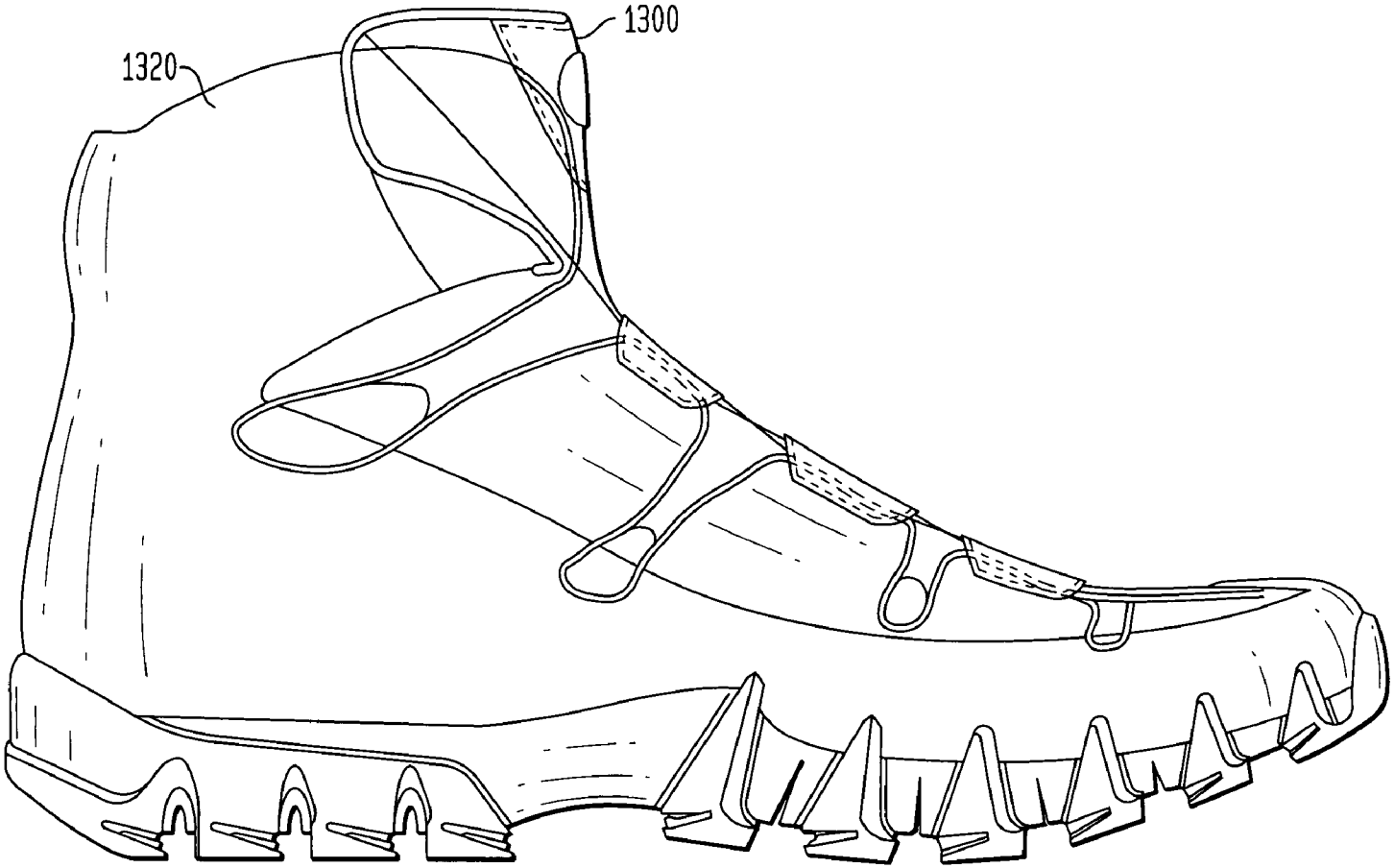
FIG. 13 is a side view of the gusset depicted in FIG. 12 as attached to an article of footwear according to the present invention.

FIG. 12 shows one embodiment of a gusset 1300 according to the present invention, which may be used, for example, with any of the article of footwear discussed herein. The gusset 1300 may be disposed along the anterior of the upper in order to connect the tongue to the upper to prevent water and rocks or other objects from entering the boot or other article of footwear. The gusset 1300 preferably includes a fabric region 1302 which is preferably comprises the same fabric, fabrics, or layers of fabric as the upper of the boot, e.g., SUPERFABRIC brand fabric. The fabric region 1302 may be cut and/or puncture proof, and may also comprise a flame retardant material as discussed above. The gusset 1300 preferably also includes a layer of stretchable waterproof material 1304 which may be neoprene or LYCRA brand stretch fiber, manufactured by Invista. Overlays 1306, for example synthetic overlays reduce friction and provide a buffer between the upper and the laces. The gusset 1300 preferably folds over itself at 1310 to provide a complete waterproof seal with the article of footwear, such as article of footwear 1320 of FIG. 13. The gusset 1300 preferably has edges 1308 where the gusset 1300 connects to the upper of the article of footwear 1320. The gusset 1300 is preferably connected to the article of footwear 1320 with a series of stitching and waterproof sealant.

Figure 15:
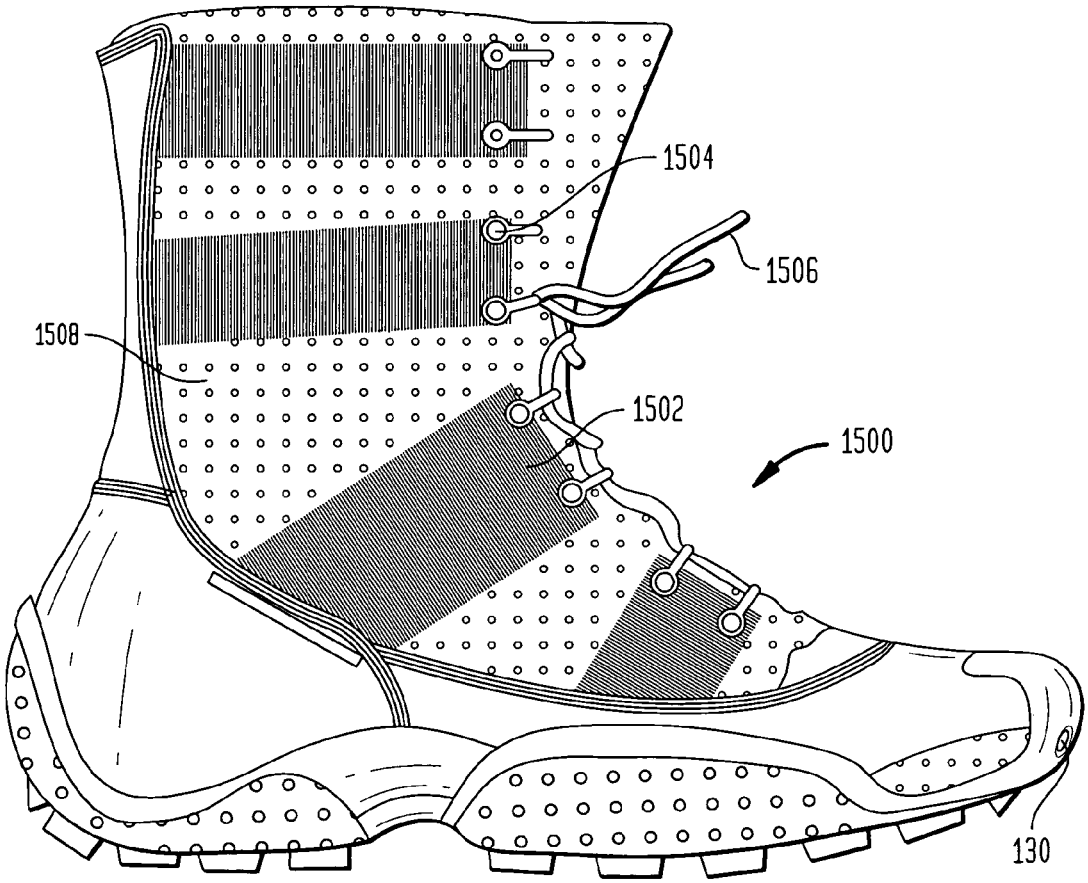
FIG. 15 is a side view of an alternate embodiment of an article of footwear according to the present invention.

FIG. 15 depicts an alternate embodiment of an article of footwear 1500 according to the present invention. The article of footwear 1500 preferably is configured as a boot, although other styles of footwear may be selected. The boot 1500 has a plurality of support straps 1502. The support straps 1502 act to secure the boot 1500 to the wearer's foot when the laces 1506 are pulled through the eyelets 1504. The support straps 1502 are preferably made of an elasticized material and secured to the upper 1508 with stitching. The support straps 1502 provide a more snug fit of the boot 1500 to the foot of the wearer when used in conjunction with the lacing system. As shown, at least one drainage hole 130 may be provided in the toe region of the boot 1500.

Figure 16:
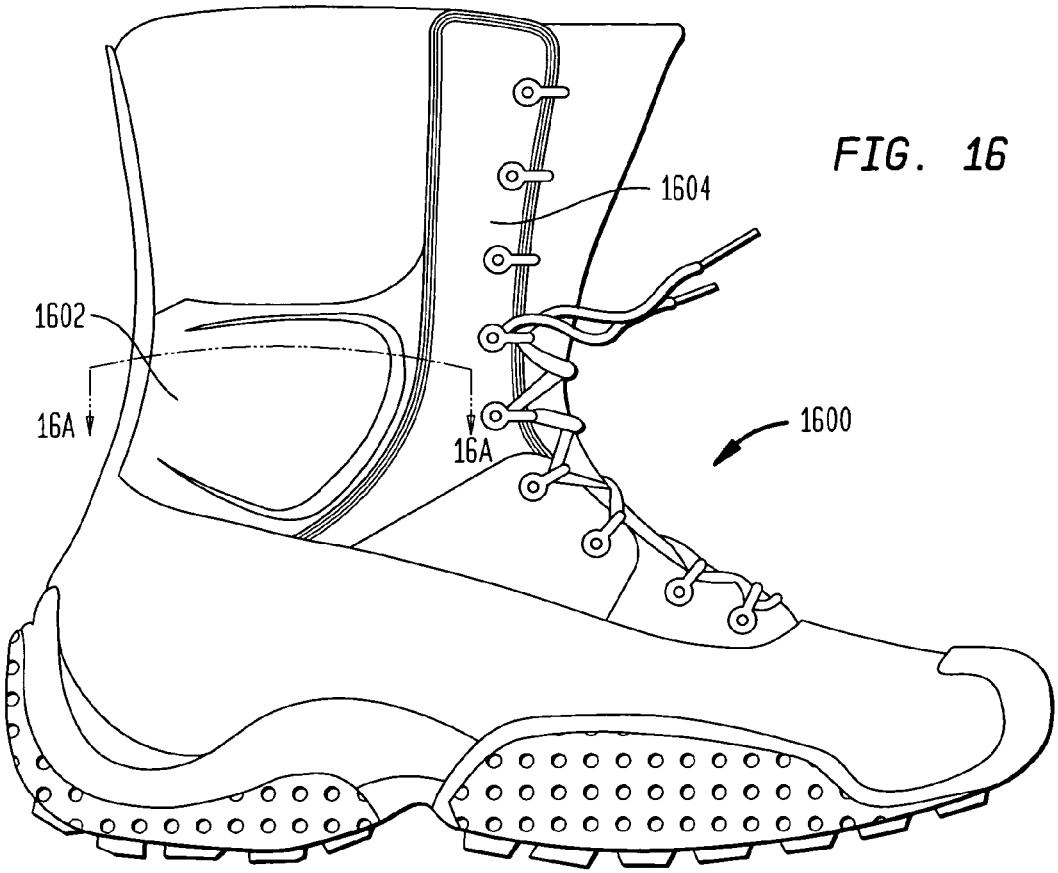
FIG. 16 is a side view of an alternate embodiment of an article of footwear according to the present invention.
Figure 16A:
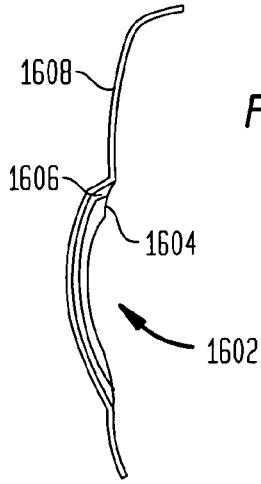
FIG. 16A is a cross section view of an ankle protecting plate according to one embodiment of the invention.

FIGS. 16 and 16A depict an alternate embodiment of an article of footwear 1600 according to the present invention. The article of footwear 1600 preferably comprises a boot, although other types of footwear may be selected. The boot 1600 preferably includes an ankle protection plate 1602 inside or along the upper 1604 of the boot 1600. FIG. 16A shows a cross section of the ankle protection plate 1602 taken from the boot 1600 at cross section 16A-16A. The ankle protection plate 1602 preferably comprises a layer of cushioning 1604 such as casted polyurethane ("CPU"), silicone, EVA, surgical foam, leather, etc. An overlay 1606 may also be included that preferably covers the cushioning 1604. In addition, a polymer shell 1608 may also be utilized, which may part of an overlay section. The foam cushioning 1604 provides padding for the ankle bone and thus comfort for the user. The overlay 1606 serves to dissipate any impact to the polymer shell 1608 across a large surface area to minimize or prevent injury to the wearer. The polymer shell 1608 is preferably sufficiently rigid to minimize or completely prevent injury to the ankle of a user from impact.

Figure 24A:
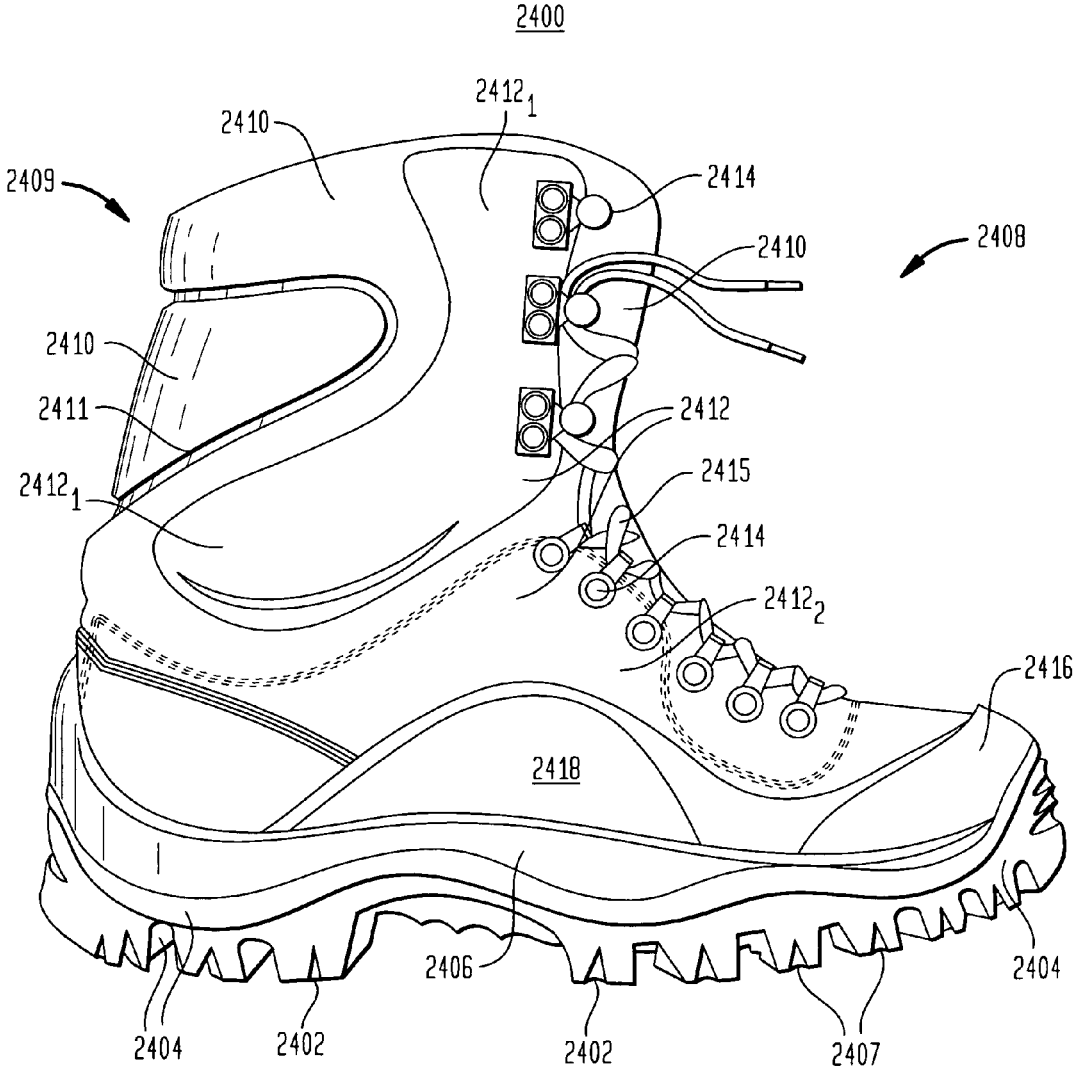
FIGS. 24A-B illustrate side views of alternative embodiments of articles of footwear according to aspects of the present invention.

FIG. 24A shows an alternate embodiment of an article of footwear 2400 according to the present invention. The article of footwear 2400 desirably comprises a boot, although other types and styles of footwear may be employed. The boot 2400 preferably has a plurality of lugs 2402 on the ground contacting portion of outsole 2404, which connects to midsole 2406. As shown in this figure, the outsole 2404 is a unitary structure. Preferably, the outsole 2404 comprises rubber, although any of the other outsole materials discussed herein may also be employed. The midsole 2406 desirably includes a shock diffusion plate therein (not shown). The midsole 2406 preferably comprises PU, although any of the other midsole materials discussed herein may also be employed. The lugs 2402 preferably contain recesses 2407 on the bottom surface thereof for increased traction.

Upper 2408 of the boot 2400 depicted in FIG. 24A includes a shaft 2409. The shaft 2409 preferably extends from the ankle area to the top line of the collar on the upper 2408. The shaft 2409 preferably comprises neoprene material or the like covered by an external layer or overlay 2410. The overlay 2410 desirably comprises a mesh material such as a stretch mesh for flexibility and ventilation, and/or a protective fabric for enhanced durability and protection. Most preferably, the mesh overlay 2410 comprises a nylon, e.g. a stretch nylon, that is lightweight and is tear resistant. A puncture resistant mesh may also be used. The mesh overlay 2410 may be segmented or otherwise separated into multiple sections. For instance, separator 2411, which may be a recess, depression, void, seam or gap within one or more layers of shaft materials enables greater flexibility of the shaft 2409 without compromising fit or comfort.

One or more regions of material 2412 preferably cover sections of the shaft 2409. The material regions 2412 are preferably made of a fabric which may be waterproof, puncture proof, and/or flame retardant as discussed above. In one alternative, material regions 2412 comprise leather that is waterproof and provides structure, protection and durability. In another alternative, the material regions 2412 comprise a material such as SUPERFABRIC brand materials from HDM Inc, which is discussed above. As seen in the figure, the material regions 2412 may include several separate sections or areas of material. One or more of these sections, namely regions $\mathbf{2412}_1$ and $\mathbf{2412}_2$, may include eyelets or other fastening members 2414 thereon for receiving a lace 2415. The section $\mathbf{2412}_1$ is preferably formed as "extended" eyestay section. Here, the eyestay section is extended because it extends out to cover portions of mesh overlay 2410 beyond the eyestay itself. However, the extended eyestay section provides structure and protection to the exterior of the boot 2400 without compromising comfort and flexibility of the shaft within the upper 2408.

An inner bootie (not shown) of, e.g., GORETEX brand material or the like may be disposed within the upper 2408, and may be at least partly surrounded by the shaft 2409. The bootie provides waterproof protection for the wearer. The bootie may be, e.g., a bootie such as the bootie 1802 discussed above with respect to FIG. 18.

The boot 2400 preferably also includes a toe guard 2416 and/or a stabilizing member 2418. The toe guard 2416 provides enhanced protection for the wearer's toes. The stabilizing member 2418 may be positioned along one or both of the medial and lateral sides of the boot 2400 for lateral support and protection of the wearer's foot. The toe guard 2416 and the stabilizing member 2418 may be discrete components or formed as an integral unit. The toe guard 2416 and the stabilizing member 2418 are desirably formed of TPU, although other rigid and durable materials may be employed.

The boot 2400 may be adapted for use in wintry environments. In this case, the external components of the boot 2400 may be colored white, off-white, gray, or a combination of these colors. Furthermore, an insulative footbed, such as footbed 2120, may be utilized with the boot 2400 for added warmth in extreme and cold environments. While the shaft 2409 of neoprene or other material may provide insulation, additional insulative lining materials may be used as well, for example in conjunction with the bootie to ensure warmth as well as waterproof protection.

Figure 24B:
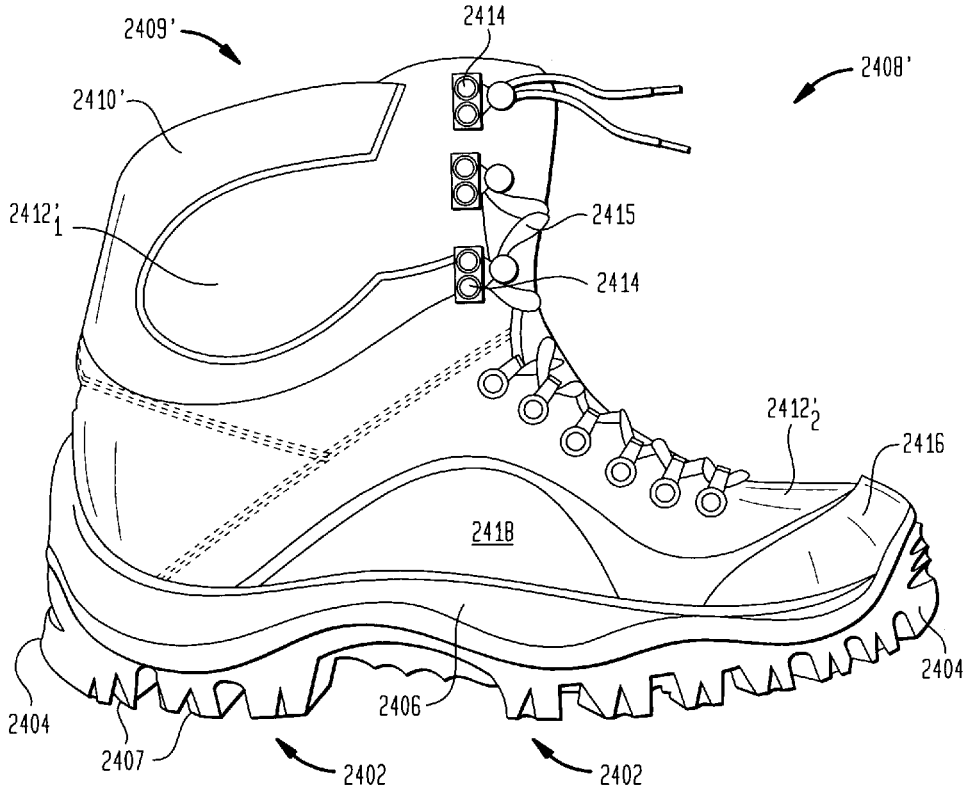

FIG. 24B illustrates shows an alternate embodiment of an article of footwear 2400' according to the present invention. The article of footwear 2400' desirably comprises a boot, although other types and styles of footwear may be employed. The boot 2400' is substantially similar to the boot 2400, and the main differences will now be described. The boot 2400 is preferably at least 7 inches in height as measured from the bottom of the outsole to the top line of the collar. More preferably, the boot 2400 is on the order of 8 inches in height. The boot 2400' is preferably between about to 8 inches in height, more preferably on the order of 6 inches in height. As with the boot 2400, the upper 2408' of the boot 2400' includes shaft 2409' having overlay 2410' and material regions 2412' over portions of the overlay 2410'. The materials of these components may be the same as described above, although the coloring of the external components may differ. For instance, instead of an white/off white/gray pattern, the boot 2400' may have forest or desert camouflage pattern. However, it should be understood that different articles of footwear may be less than 6 inches or greater than inches in height, and may employ any color combination desired.

Furthermore, as seen in FIG. 24B, the material region 2412' may include several separate sections or areas of material. One or more of these sections, namely sections $\mathbf{2412'}_1$ and $\mathbf{2412'}_2$, may include eyelets or other fastening members 2414 thereon for receiving the lace 2415. The section $\mathbf{2412'}_1$ is preferably formed as an "extended" eyestay section as with the section $\mathbf{2412}_1$. In this embodiment, the elements 2410' and 2412' may have a different layout or configuration than shown in the boot 2400, although the layout/configuration may be the same if desired.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims. By way of example only, while different embodiments described above illustrate specific features, it is within the scope of the present invention to combine or interchange different features among the various embodiments to create other variants. Any of the features in any of the embodiments can be combined or interchanged with any other features in any of the other embodiments. For instance, any of the footbeds, including the adjustable footbeds, may be used with any article of footwear herein. The different outsoles may be used with or without drainage holes. Upper materials that are cut proof, puncture proof, fire retardant or water repelling may be used alone or in combination with one another and other upper materials. Booties, drainage plugs, chimney structures etc. may also be used in any of the articles of footwear herein.

The invention claimed is:

1. An article of footwear, comprising:

an outsole having a first surface and a second surface remote from the first surface for contacting the ground and having lugs thereon;

an upper attached to the first surface of the outsole, the upper having an interior surface defining a cavity for receiving a foot of a wearer and an exterior surface opposite the interior surface;

a toe portion disposed along the toe region of the cavity, the toe portion including at least one drainage hole operable to discharge liquid from the cavity of the upper to the external environment;

a footbed disposed within the cavity of the upper and having a forefoot region and a heel region, the footbed including at least one drainage hole therein for draining the liquid away from the wearer's foot and to the drainage hole of the toe portion a cartridge including a fastening mechanism for releasably connecting to the forefoot region of the footbed, the cartridge also including at least one drainage hole therein that aligns with the at least one drainage hole of the footbed.

2. The article of footwear of claim 1, wherein the at least one drainage hole of the toe portion is a one-way drainage hole.

3. The article of footwear of claim 1, further comprising at least one removable drainage plug disposed on the at least one drainage hole of the toe portion.

4. The article of footwear of claim 1, wherein the article of footwear further comprises a support saddle connected to at least the heel region of the footbed, the support saddle including medial and lateral sidewall members therealong.

5. The article of footwear of claim 4, wherein the support saddle includes a heel receptacle and the heel region of the footbed includes a cushioning member adapted to fit the heel receptacle.

6. The article of footwear of claim 5, wherein the support saddle includes a contoured instep region operable to permit fastening of different sized cartridges to the forefoot region of the footbed.

7. The article of footwear of claim 1, wherein the footbed includes a puncture resistant layer.

8. The article of footwear of claim 1, wherein the lugs on the outsole are sound reducing non-planar lugs.

9. The article of footwear of claim 1, wherein the outsole is a low profile outsole of less than 4 mm thickness.

10. The article of footwear of claim 9, further comprising a midsole coupling the upper to the outsole, the midsole being a low profile midsole of less than 4 mm thickness.

11. An article of footwear, comprising:

an outsole having a first surface and a second surface remote from the first surface for contacting the ground and having lugs thereon;

an upper attached to the first surface of the outsole, the upper having an interior surface defining a cavity for receiving a foot of a wearer and an exterior surface opposite the interior surface;

a toe portion disposed along the toe region of the cavity, the toe portion including at least one drainage hole operable to discharge liquid from the cavity of the upper to the external environment;

a footbed disposed within the cavity of the upper and having a forefoot region and a heel region, the footbed including at least one drainage hole therein for draining the liquid away from the wearer's foot and to the drainage hole of the toe portion; and a support saddle connected to at least the heel region of the footbed, the support saddle including medial and lateral sidewall members therealong, wherein the support saddle includes a heel receptacle and the heel region of the footbed includes a cushioning member adapted to fit the heel receptacle.

12. The article of footwear of claim 11, wherein the at least one drainage hole of the toe portion is a one-way drainage hole.

13. The article of footwear of claim 11, further comprising at least one removable drainage plug disposed on the at least one drainage hole of the toe portion.

14. The article of footwear of claim 11, further comprising a cartridge including a fastening mechanism for releasably connecting to the forefoot region of the footbed, the cartridge also including at least one drainage hole therein that aligns with the at least one drainage hole of the footbed.

15. The article of footwear of claim 11, wherein the support saddle includes a contoured instep region operable to permit fastening of different sized cartridges to the forefoot region of the footbed.

16. The article of footwear of claim 11, wherein the footbed includes a puncture resistant layer.

17. The article of footwear of claim 11, wherein the lugs on the outsole are sound reducing non-planar lugs.

18. The article of footwear of claim 11, wherein the outsole is a low profile outsole of less than 4 mm thickness.

19. The article of footwear of claim 18, further comprising a midsole coupling the upper to the outsole, the midsole being a low profile midsole of less than 4 mm thickness.

* * * * *

UNITED STATES PATENT AND TRADEMARK OFFICE

CERTIFICATE OF CORRECTION

PATENT NO. : 7,762,008 B1
APPLICATION NO. : 11/516859
DATED : July 27, 2010
INVENTOR(S) : Douglas E. Clark, David E. Miller and Peter Dillon It is certified that error appears in the above-identified patent and that said Letters Patent is hereby corrected as shown below:

On the Title Page, Item (57) ABSTRACT, Line 5, "include" should read -- includes --.
On the Title Page, Item (57) ABSTRACT, Line 5, delete "proof".
Col. 1, Line 37, "in past" should read -- in the past --.
Col. 1, Line 38, "utilizing" should read -- to utilize --.
Col. 1, Line 53, "convention" should read -- conventional --.
Col. 2, Line 20, "in world" should read -- in the world --.
Col. 5, Line 67, "in" should read -- is --.
Col. 6, Line 30, "synthetics can" should read -- synthetics, can --.
Col. 6, Line 47, "their" should read -- his or her --.
Col. 11, Line 19, "allow" should read -- allows --.
Col. 11, Line 67, "stiffness especially" should read -- stiffness which is especially --.
Col. 17, Line 29, "enable" should read -- enables --.
Col. 18, Line 40, "show" should read -- shown --.
Col. 18, Line 64, "around bottom" should read -- around the bottom --.
Col. 18, Line 66, "solder" should read -- soldier --.
Col. 20, Line 33, "article" should read -- articles --.
Col. 20, Line 38, "which is preferably" should read -- which preferably --.
Col. 21, Line 13, "which may" should read -- which may be --.
Col. 22, Line 31, delete "shows".
Col. 22, Line 40, "about to 8" should read -- about 5 to 8 --.
Col. 23, Claim 1, Line 34, "portion" should read -- portion; --.

Signed and Sealed this
Nineteenth Day of July, 2011

David J. Kappos

David J. Kappos
*Director of the United States Patent and Trademark Office*